US012291812B2

(12) United States Patent
Song et al.

(10) Patent No.: US 12,291,812 B2
(45) Date of Patent: May 6, 2025

(54) WASHING MACHINE AND CONTROLLING METHOD THEREOF

(71) Applicant: Samsung Electronics Co., Ltd., Suwon-si (KR)

(72) Inventors: Hyungseon Song, Suwon-si (KR); Saeeap Kim, Suwon-si (KR); Jeongchoul Park, Suwon-si (KR); Jongwoon Park, Suwon-si (KR); Heekyung Yang, Suwon-si (KR); Jiwon Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 104 days.

(21) Appl. No.: 17/310,117

(22) PCT Filed: Jun. 22, 2021

(86) PCT No.: PCT/KR2021/007822
§ 371 (c)(1),
(2) Date: Jul. 16, 2021

(87) PCT Pub. No.: WO2022/014890
PCT Pub. Date: Jan. 20, 2022

(65) Prior Publication Data

US 2022/0275556 A1 Sep. 1, 2022

(30) Foreign Application Priority Data

Jul. 17, 2020 (KR) ..... 10-2020-0089126

(51) Int. Cl.
*D06F 33/70* (2020.01)
*D06F 33/50* (2020.01)
*D06F 33/72* (2020.01)

(52) U.S. Cl.
CPC ..... *D06F 33/70* (2020.02); *D06F 33/50* (2020.02); *D06F 33/72* (2020.02)

(58) Field of Classification Search
CPC ..... D06F 33/70; D06F 33/50; D06F 33/72; D06F 34/28
See application file for complete search history.

(56) References Cited

U.S. PATENT DOCUMENTS 7,088,238 B2 8/2006 Karaoguz et al.
8,621,049 B2 12/2013 Ebrom et al.
(Continued)

FOREIGN PATENT DOCUMENTS

CN 108729117 A 11/2018
EP 1548174 A1 6/2005
(Continued)

OTHER PUBLICATIONS

International Search Report and Written Opinion of the International Searching Authority in connection with International Application No. PCT/KR2021/007822 issued Sep. 29, 2021, 14 pages.
(Continued)

*Primary Examiner* — Joseph L. Perrin
*Assistant Examiner* — Kevin G Lee

(57) ABSTRACT

A washing machine is provided. The washing machine includes: a display; a communication interface; and a processor, wherein the processor controls the display to display a user interface (UI) for overall control of the washing machine and a dryer connected to the washing machine in communication based on a first user input selecting a washing course being received, identifies a drying course of the dryer based on the washing course selected by the first user input and a control option selected by a second user input based on the second user input selecting one of the plurality of control options included in the UI being
(Continued)

| ITEM | TIME (h) | POWER CONSUMPTION(Wh) | REMARK |
|---|---|---|---|
| WASHING MACHINE | 1 | 2000 | STANDARD COURSE, WASHING TEMPERATURE OF 40 DEGREES, THREE RINSING TIMES, MEDIUM DEHYDRATION INTENSITY |
| DRYER | 2 | 3000 | STANDARD COURSE, DRYING TEMPERATURE OF 60 DEGREES |
| TOTAL | 3 | 5000 | |

| ITEM | TIME (h) | POWER CONSUMPTION(Wh) | REMARK |
|---|---|---|---|
| WASHING MACHINE | 1 | 1500 | STANDARD COURSE, WASHING TEMPERATURE OF 20 DEGREES, TWO RINSING TIMES, STRONG DEHYDRATION INTENSITY |
| DRYER | 3 | 2500 | LOW NOISE COURSE, DRYING TEMPERATURE OF 50 DEGREES |
| TOTAL | 4 | 4000 | |

received, and control the communication interface to transmit information corresponding to the identified drying course.

17 Claims, 30 Drawing Sheets

(56) References Cited

U.S. PATENT DOCUMENTS

| | | | | |
|---|---|---|---|---|
| 8,624,728 | B2 | 1/2014 | Karaoguz et al. | |
| 8,733,132 | B2 * | 5/2014 | Motamedi | D06F 34/32 68/12.27 |
| 2003/0115682 | A1 | 6/2003 | Gardner | |
| 2010/0287711 | A1 * | 11/2010 | Geyer | D06F 34/28 68/12.01 |
| 2015/0069933 | A1 * | 3/2015 | Ragogna | D06F 33/32 68/12.02 |
| 2017/0183811 | A1 * | 6/2017 | Kang | D06F 34/05 |
| 2018/0305851 | A1 | 10/2018 | Kwon et al. | |
| 2020/0002872 | A1 | 1/2020 | Kim | |
| 2020/0024784 | A1 | 1/2020 | Yoon et al. | |
| 2021/0164145 | A1 | 6/2021 | Kim et al. | |
| 2021/0207309 | A1 | 7/2021 | Kim | |
| 2021/0262140 | A1 | 8/2021 | Kim et al. | |

FOREIGN PATENT DOCUMENTS

| | | | | |
|---|---|---|---|---|
| EP | 3396051 | B1 * | 6/2022 | D06F 33/00 |
| JP | 2013-090810 | A | 5/2013 | |
| JP | 2013-183842 | A | 9/2013 | |
| KR | 10-1154980 | B1 | 6/2012 | |
| KR | 10-1637350 | B1 | 7/2016 | |
| KR | 10-2019-0090734 | A | 8/2019 | |
| KR | 10-2209509 | B1 | 1/2021 | |
| KR | 10-2253259 | B1 | 5/2021 | |
| KR | 10-2021-0087764 | A | 7/2021 | |
| WO | WO-2006087735 | A1 * | 8/2006 | A47L 15/4293 |

OTHER PUBLICATIONS

Supplementary European Search Report dated Jul. 21, 2023, in connection with European Application No. 21841616.2, 11 pages.

* cited by examiner

| ITEM | TIME (h) | POWER CONSUMPTION (Wh) |
|---|---|---|
| WASHING MACHINE | 1 | 2000 |
| DRYER | 2 | 3000 |
| TOTAL | 3 | 5000 |

| ITEM | TIME (h) | POWER CONSUMPTION (Wh) |
|---|---|---|
| WASHING MACHINE | 1 | 1500 |
| DRYER | 3 | 2500 |
| TOTAL | 4 | 4000 |

FIG. 8

ENERGY SAVING IS SELECTED

GENERAL

801

| ITEM | TIME (h) | POWER CONSUMPTION(Wh) | REMARK |
|---|---|---|---|
| WASHING MACHINE | 1 | 2000 | STANDARD COURSE, WASHING TEMPERATURE OF 40 DEGREES, THREE RINSING TIMES, MEDIUM DEHYDRATION INTENSITY |
| DRYER | 2 | 3000 | STANDARD COURSE, DRYING TEMPERATURE OF 60 DEGREES |
| TOTAL | 3 | 5000 | |

ENERGY SAVING

802

| ITEM | TIME (h) | POWER CONSUMPTION(Wh) | REMARK |
|---|---|---|---|
| WASHING MACHINE | 1 | 1500 | STANDARD COURSE, WASHING TEMPERATURE OF 20 DEGREES, TWO RINSING TIMES, STRONG DEHYDRATION INTENSITY |
| DRYER | 3 | 2500 | LOW NOISE COURSE, DRYING TEMPERATURE OF 50 DEGREES |
| TOTAL | 4 | 4000 | |

800

FIG. 11

SELECT DESIRED CONTROL OPTION

ENERGY SAVING

| ITEM | TIME (h) | POWER CONSUMPTION (Wh) |
|---|---|---|
| WASHING MACHINE | 1 | 1500 |
| DRYER | 3 | 2500 |
| TOTAL | 4 | 4000 |

1101

GENERAL

| ITEM | TIME (h) | POWER CONSUMPTION (Wh) |
|---|---|---|
| WASHING MACHINE | 1 | 2000 |
| DRYER | 2 | 3000 |
| TOTAL | 3 | 5000 |

1102

TIME SAVING

| ITEM | TIME (h) | POWER CONSUMPTION (Wh) |
|---|---|---|
| WASHING MACHINE | 1 | 3000 |
| DRYER | 1 | 3000 |
| TOTAL | 2 | 6000 |

1103

1100

FIG. 12

| WASHING OPERATION COURSE | CONTROL OPTION | WASHING OPTION BASED ON CONTROL OPTION | DRYING OPTION BASED ON CONTROL OPTION |
|---|---|---|---|
| STANDARD | ENERGY SAVING | STANDARD + LOW WATER TEMPERATURE, WEAK DEHYDRATION | STANDARD + LOW DRYING LEVEL |
| | GENERAL | STANDARD + DEFAULT OPTION | CUSTOM DRYING + DEFAULT OPTION |
| | TIME SAVING | STANDARD + STRONG DEHYDRATION | FAST DRYING + DEFAULT OPTION |
| FUTON | ENERGY SAVING | FUTON + LOW WATER TEMPERATURE, WEAK DEHYDRATION | FUTON + LOW DRYING LEVEL |
| | GENERAL | FUTON + DEFAULT OPTION | FUTON + DEFAULT OPTION |
| | TIME SAVING | FUTON + STRONG DEHYDRATION | FAST DRYING + DEFAULT OPTION |

1200

FIG. 13

| WASHING OPERATION COURSE | CONTROL OPTION | WASHING OPTION BASED ON CONTROL OPTION | | | | | DRYING OPTION BASED ON CONTROL OPTION | | | | |
|---|---|---|---|---|---|---|---|---|---|---|---|
| | | TIME (h) | POWER CONSUMPTION (Wh) | WASHING TEMPERATURE (° C) | NUMBER OF RINSING | DEHYDRATION INTENSITY | COURSE | TIME (h) | POWER CONSUMPTION (Wh) | DRYING TEMPERATURE (° C) | ROTATIONAL SPEED |
| STANDARD | ENERGY SAVING | 1 | 1500 | 30 | 2 | WEAK | LOW NOISE | 3 | 2500 | 40 | SLOW |
| | GENERAL | 1 | 2000 | 40 | 2 | MEDIUM | GENERAL | 2 | 3000 | 60 | MEDIUM |
| | TIME SAVING | 1 | 3000 | 50 | 2 | STRONGEST | FAST | 1 | 3000 | 80 | FAST |
| FUTON | ENERGY SAVING | 2 | 2600 | 30 | 3 | WEAK | LOW NOISE | 3 | 3000 | 80 | SLOW |
| | GENERAL | 2 | 3000 | 40 | 3 | MEDIUM | GENERAL | 2 | 5000 | 80 | MEDIUM |
| | TIME SAVING | 2 | 5000 | 50 | 3 | STRONGEST | FAST | 1 | 6500 | 80 | FAST |

1300

FIG. 14

| user ID | device ID | device type |
|---|---|---|
| user1 | #01 | washer |
| user1 | #02 | dryer |
| user1 | #03 | robot cleaner |
| user2 | #04 | washer |
| user2 | #05 | TV |

1400

FIG. 21

| DETAILED OPTION OF WASHING COURSE | | | | | | |
|---|---|---|---|---|---|---|
| COURSE | TIME (h) | POWER CONSUMPTION (Wh) | WASHING TEMPERATURE (° C) | NUMBER OF RINSING | DEHYDRATION INTENSITY | WASHING DEGREE |
| 1-1 | 1 | 1200 | 30 | 2 | WEAKEST | LOWEST |
| 1-2 | 1 | 1500 | 30 | 2 | WEAK | LOW |
| 1-3 | 1 | 2000 | 40 | 2 | MEDIUM | MEDIUM |
| 1-4 | 1 | 2500 | 40 | 2 | STRONG | MEDIUM |
| 1-5 | 1 | 3000 | 50 | 2 | STRONGEST | HIGH |
| 2-1 | 2 | 2200 | 30 | 3 | WEAKEST | LOW |
| 2-2 | 2 | 2600 | 30 | 3 | WEAK | MEDIUM |
| 2-3 | 2 | 3000 | 40 | 3 | MEDIUM | HIGH |
| 2-4 | 2 | 4000 | 40 | 3 | STRONG | HIGH |
| 2-5 | 2 | 5000 | 50 | 3 | STRONGEST | HIGHEST |

2100

⋮

FIG. 22

| DETAILED OPTION OF DRYING COURSE | | | | | |
|---|---|---|---|---|---|
| COURSE | TIME (h) | POWER CONSUMPTION (Wh) | DRYING TEMEPRATURE (° C) | ROTATIONAL SPEED | DRYING DEGREE |
| 1-1 | 1 | 1000 | 40 | FAST | LOWEST |
| 1-2 | 1 | 1200 | 50 | FAST | LOW |
| 1-3 | 1 | 1700 | 60 | FAST | MEDIUM |
| 1-4 | 1 | 2200 | 70 | FAST | MEDIUM |
| 1-5 | 1 | 3000 | 80 | FAST | MEDIUM |
| 2-1 | 2 | 1500 | 40 | MEDIUM | LOW |
| 2-2 | 2 | 2000 | 50 | MEDIUM | MEDIUM |
| 2-3 | 2 | 3000 | 60 | MEDIUM | HIGH |
| 2-4 | 2 | 3300 | 70 | MEDIUM | HIGH |
| 2-5 | 2 | 5000 | 80 | MEDIUM | HIGHEST |
| 3-1 | 3 | 2500 | 40 | SLOW | HIGH |
| 3-2 | 3 | 2900 | 50 | SLOW | HIGH |
| 3-3 | 3 | 3500 | 60 | SLOW | HIGHEST |
| 3-4 | 3 | 5000 | 70 | SLOW | HIGHEST |
| 3-5 | 3 | 3500 | 80 | SLOW | HIGHEST |

2200

⋮

FIG. 23

| QUALITY BASED ON COMBINATION OF WASHING COURSE AND DRYING COURSE | | | |
|---|---|---|---|
| | WASHING MACHINE | DRYER | QUALITY |
| case 1 | 1-1 | 1-1 | 1 |
| case 2 | 1-1 | 1-2 | 2 |
| case 3 | 1-1 | 1-3 | 3 |
| case 4 | 1-1 | 1-4 | 4 |
| case 5 | 1-1 | 1-5 | 5 |
| case 6 | 1-2 | 1-1 | 3 |
| case 7 | 1-2 | 1-2 | 4 |
| case 8 | 1-2 | 1-3 | 5 |
| case 9 | 1-2 | 1-4 | 6 |
| case 10 | 1-2 | 1-5 | 7 |
| case 11 | 1-3 | 1-1 | 5 |
| case 12 | 1-3 | 1-2 | 6 |
| case 13 | 1-3 | 1-3 | 7 |
| case 14 | 1-3 | 1-4 | 8 |
| case 15 | 1-3 | 1-5 | 9 |

2300

⋮

WASHING MACHINE AND CONTROLLING METHOD THEREOF

CROSS-REFERENCE TO RELATED APPLICATIONS

This application is a 371 National Stage of International Application No. PCT/KR2021/007822, filed Jun. 22, 2021, which claims priority to Korean Patent Application No. 10-2020-0089126, filed on Jul. 17, 2020, the disclosures of which are herein incorporated by reference in their entirety.

BACKGROUND

1. Field

Apparatuses and methods consistent with the disclosure relate to a washing machine and a controlling method thereof, and more particularly, to a washing machine determining a drying course of a dryer based on a washing course received from the washing machine, and a controlling method thereof.

2. Description of Related Art

To overall control a washing machine and a dryer, a washing course of the washing machine and a drying course of the dryer may be mapped 1-to-1. For example, if the washing machine performs a standard washing course, the dryer may also perform a standard drying course, and if the washing machine performs a fast washing course, the dryer may also perform a fast drying course.

However, in case that the washing course and the drying course are mapped 1-to-1 as described above, it is impossible either to save overall operation time of washing and drying or to save overall energy thereof, while maintaining predetermined quality thereof. For example, in case of setting both the washing machine and dryer to the fast mode, it may save the time, but lower the overall quality of washing and drying.

SUMMARY

The disclosure provides a washing machine identifying one drying course among a plurality of drying courses based on a washing course and a control option thereof, selected by a user, and obtaining a drying result based on the control option, and a controlling method thereof.

According to an embodiment of the disclosure, a washing machine includes: a display; a communication interface; and a processor, wherein the processor controls the display to display a user interface (UI) for overall control of the washing machine and a dryer connected to the washing machine in communication if a first user input selecting a washing course is received (or based on a first user input selecting a washing course being received), identifies a drying course of the dryer based on the washing course selected by the first user input and a control option selected by a second user input if the second user input selecting one of the plurality of control options included in the UI is received (or based on the second user input selecting one of the plurality of control options included in the UI being received), and controls the communication interface to transmit information corresponding to the identified drying course to the dryer.

The plurality of control options are the control options applicable to both the washing course of the washing machine and the drying course of the dryer.

The control option is an option for at least one of energy saving control, general control or time saving control.

The processor is configured to obtain control information on the selected washing course based on the selected control option and obtain the drying course of the dryer and control information on the drying course based on the control option, based on the obtained control information.

The processor is configured to control the display to display a UI including the control information on the washing course and the control information on the drying course.

The processor is configured to control guide information recommending at least one control option among the plurality of control options included in the UI to be provided based on a user history related to at least one of the washing machine or the dryer.

The processor is configured to determine an order in which the plurality of control options included in the UI are displayed based on a user history related to at least one of the washing machine or the dryer.

The control option includes an option for at least one of energy saving control, general control or time saving control, control power corresponding to the energy saving control is determined based on a user history related to at least one of the washing machine or the dryer, and control time corresponding to the time saving control is determined based on a user history related to at least one of the washing machine or the dryer.

The processor is configured to, if the drying course of the dryer is identified, identify a detailed option of the drying course based on the selected control option and control the information including the detailed option of the identified specific drying course to be transmitted to the dryer.

The processor is configured to control the information corresponding to the identified drying course to be transmitted to the dryer through an external server.

According to another embodiment of the disclosure, a controlling method of a washing machine includes: displaying a user interface (UI) for overall control of the washing machine and a dryer connected to the washing machine in communication if a first user input selecting a washing course is received; identifying a drying course of the dryer based on the washing course selected by the first user input and a control option selected by a second user input based on the second user input selecting one of the plurality of control options included in the UI being received; and transmitting information corresponding to the identified drying course to the dryer.

The plurality of control options are the control options applicable to both the washing course of the washing machine and the drying course of the dryer.

The control option is an option for at least one of energy saving control, general control or time saving control.

The controlling method further comprises obtaining control information on the selected washing course based on the selected control option, and obtaining the drying course of the dryer and control information on the drying course based on the control option, based on the obtained control information.

In the displaying of the UI, a UI including the control information on the washing course and the control information on the drying course is displayed.

BRIEF DESCRIPTION OF THE DRAWINGS

FIG. 8 is a diagram showing another UI displayed after one control option is selected from the UI for overall control according to another embodiment;

FIG. 11 is a diagram showing another UI displayed after one control option is selected from the UI for overall control according to another embodiment;

FIG. 12 is a diagram showing a detailed option for the overall control of the washing machine and the dryer according to an embodiment;

FIG. 13 is a diagram showing a detailed option for the overall control of the washing machine and the dryer according to another embodiment;

FIG. 14 is a diagram showing identification information on a plurality of devices connected to the server;

FIG. 21 is a table showing a detailed option of a washing course performed by the washing machine;

FIG. 22 is a table showing a detailed option of a drying course performed by the dryer;

FIG. 23 is a table showing a quality level of the washing course and the drying course based on a combination thereof;

DETAILED DESCRIPTION

Figure 1:
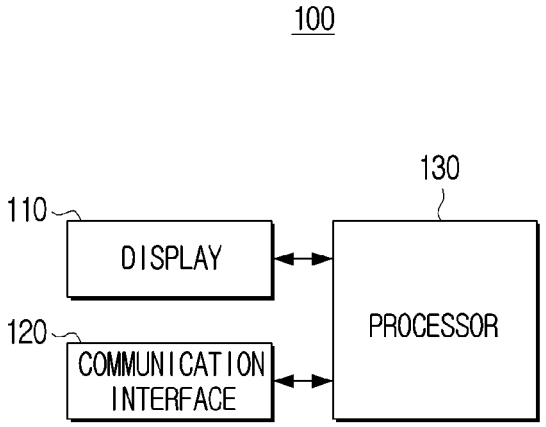
FIG. 1 is a block diagram showing a washing machine according to an embodiment of the disclosure.

Hereinafter, the disclosure is described in detail with reference to the accompanying drawings.

General terms that are currently widely used were selected as terms used in embodiments of the disclosure in consideration of functions in the disclosure, but may be changed depending on the intention of those skilled in the art or a judicial precedent, the emergence of a new technique, and the like. In addition, in a specific case, terms arbitrarily chosen by an applicant may exist. In this case, the meanings of such terms are mentioned in detail in corresponding description portions of the disclosure. Therefore, the terms used in the embodiments of the disclosure need to be defined on the basis of the meanings of the terms and the contents throughout the disclosure rather than simple names of the terms.

In the disclosure, an expression 'have', 'may have', 'include', 'may include' or the like, means existence of a corresponding feature (for example, a numerical value, a function, an operation, a component such as a part or the like), and does not exclude existence of an additional feature.

In the specification, 'A or/and B' may indicate either 'A or B', or 'both of A and B.'

Expressions 'first', 'second' or the like, used in the disclosure may indicate various components regardless of a sequence and/or importance of the components. These expressions are used only in order to distinguish one component from the other components, and do not limit the corresponding components.

In case that any component (for example, a first component) is mentioned to be (operatively or communicatively) coupled with/to or connected to another component (for example, a second component), it is to be understood that the any component is directly coupled to the another component or may be coupled to the another component through other component (for example, a third component).

Singular forms used herein are intended to include plural forms unless explicitly indicated otherwise. It is to be understood that a term 'include' or 'formed of' used in the specification specifies the presence of features, numerals, steps, operations, components, parts or combinations thereof, which is mentioned in the specification, and does not preclude the presence or addition of one or more other features, numerals, steps, operations, components, parts or combinations thereof.

In the embodiments, a 'module' or a '~er/~or' may perform at least one function or operation, and be implemented by hardware or software or be implemented by a combination of hardware and software. In addition, a plurality of 'modules' or a plurality of '~ers/~ors' may be integrated into at least one module and be implemented by at least one processor (not illustrated) except for a 'module' or a '~er/or' that needs to be implemented by a specific hardware.

In the specification, such a term as 'user' may refer to a person who uses an electronic device or a device (e.g., an artificial intelligence electronic device) which uses an electronic device.

Hereinafter, embodiments of the disclosure are described in detail with reference to the accompanying drawings.

FIG. 1 is a block diagram showing a washing machine according to an embodiment of the disclosure.

Referring to FIG. 1, a washing machine 100 may include a display 110, a communication interface 120 and a processor 130.

The washing machine 100 may be a device washing laundry using power of a motor, and may be a device performing operations such as a washing process, a rinsing process, and a dehydration process.

The display 110 may be implemented as various types of displays such as a liquid crystal display (LCD), an organic light emitting diode (OLED) display, a plasma display panel (PDP). The display 110 may also include a driving circuit, a backlight unit and the like, that may be implemented in a form such as a-si thin film transistor (TFT), a low temperature poly silicon (LTPS) TFT, an organic TFT (OTFT). Meanwhile, the display 110 may be implemented in a touch screen combined with a touch sensor, a flexible display, a three-dimensional (3D) display or the like.

In addition, the display 110 may include not only a display panel outputting an image, but also a bezel housing the display panel according to an embodiment of the disclosure. In particular, the bezel may include a touch sensor (not shown) detecting user interaction according to an embodiment of the disclosure.

The communication interface 120 is a component communicating with various types of external devices according to various types of communication methods. The communication interface 120 may include a wireless-fidelity (wi-fi) module, a bluetooth module, an infrared communication module, a wireless communication module and the like. Here, each communication module may be implemented in the form of at least one hardware chip.

The wi-fi module and the bluetooth module may respectively perform communication in a wi-fi manner and a bluetooth manner. In case of using the wi-fi module or the bluetooth module, it is possible to first transmit and receive various connection information such as a service set identifier (SSID), a session key, connect communication using this connection information, and then transmit and receive various information.

The infrared communication module may perform communication based on infrared data association (IrDA) technology transmitting data in a short distance using an infrared ray between visible and millimeter waves.

In addition to the above-described communication manners, the wireless communication module may include at least one communication chip performing communication based on various wireless communication standards such as zigbee, third generation (3G), 3rd generation partnership project (3GPP), long term evolution (LTE), LTE advanced (LTE-A), 4th generation (4G) and 5th generation (5G).

In addition, the communication interface 120 may include at least one of wired communication modules performing communication by using a local area network (LAN) module, an Ethernet module, a pair cable, a coaxial cable, an optical fiber cable or an ultra wide-band (UWB) module.

According to an embodiment, the communication interface 120 may use the same communication module (e.g., wi-fi module) to communicate with an external device such as a remote control and an external server.

According to another embodiment, the communication interface 120 may use a different communication module (e.g., wi-fi module) to communicate with the external device such as a remote control and the external server. For example, the communication interface 120 may use at least one of the Ethernet module or the wi-fi module to communicate with the external server, and may use the bluetooth (BT) module to communicate with the external device such as a remote control. However, this case is only an embodiment, and the communication interface 120 may use at least one communication module among various communication modules in case of communicating with the plurality of external devices or external servers.

The processor 130 may perform an overall control operation of the washing machine 100. In detail, the processor 130 may function to control the overall operation of the washing machine 100.

The processor 130 may be implemented as a digital signal processor (DSP), a microprocessor or a time controller (TCON). However, the processor 130 is not limited thereto. The processor 130 may include one or more of a central processing unit (CPU), a micro controller unit (MCU), a micro processing unit (MPU), a controller, an application processor (AP), a graphics-processing unit (GPU), a communication processor (CP) or an ARM processor, or may be defined by these terms. In addition, the processor 130 may be implemented in a system-on-chip (SoC) or a large scale integration (LSI), in which a processing algorithm is embedded, or may be implemented in the form of a field programmable gate array (FPGA). In addition, the processor 130 may perform various functions by executing computer executable instructions stored in a memory.

The processor 130 may control the display 110 to display a user interface (UI) for overall control of the washing machine 100 and a dryer 200 connected to the washing machine 100 in communication based on a first user input selecting a washing course being received, may identify a drying course of the dryer 200 based on the washing course selected by the first user input and a control option selected by a second user input based on the second user input selecting one of the plurality of control options included in the UI being received, and may control information corresponding to the identified drying course to the dryer 200 to be transmitted through the communication interface 120.

Here, the first user input may be an input selecting the washing course. The washing machine 100 may be operated in the plurality of washing courses, and the user may select one of the plurality of washing courses.

Here, the washing machine 100 may be a home appliance included in an internet of things (IoT) network. The dryer 200 may also be included in the IoT network. That is, the IoT network may include the washing machine 100 and the dryer 200. For example, the washing machine 100 may communicate with the dryer 200 through the IoT network. As another example, the washing machine 100 may communicate with the dryer 200 through the external server 300. Embodiments related thereto are described below with reference to FIGS. 15 through 20. As another example, the washing machine 100 may directly communicate with the dryer 200. An embodiment related thereto is described below with reference to FIGS. 26 and 27.

Here, the processor 130 may control the UI for overall control of the washing machine 100 and the dryer 200 to be generated and to be displayed on the display 110. Here, the UI may indicate the UI for overall control. In the disclosure, the detailed functions of the washing machine 100 and the dryer 200 may be adjusted or determined based on a user's request. Here, the washing machine 100 may provide the UI for overall control to the user in order to receive the user's request. Meanwhile, there may be various ways to provide the UI for overall control. For example, the processor 130 may control the display 110 to display the UI for overall control. As another example, the processor 130 may control information corresponding to the UI for overall control to be transmitted to a terminal device 400 for the UI for overall control to be displayed on the display of the terminal device 400. An embodiment related to this case is described below with reference to FIGS. 28 and 29.

Meanwhile, the UI for overall control may include the plurality of control options. Here, the control option may indicate a menu or item for how to control the washing machine 100 and dryer 200. Here, the control option may be an option for at least one of energy saving control, general control or time saving control. Here, the option for the "energy saving" control may indicate a control option for operating the washing machine 100 and the dryer 200 in a course having low power consumption. In addition, the option for the "general" control may indicate a control option for operating the washing machine 100 and the dryer 200 in a predetermined course. In addition, the option for the "time saving" control may indicate a control option for operating the washing machine 100 and the dryer 200 in a course having minimum required time.

Meanwhile, a detailed description of the UI for overall control is described below with reference to FIGS. 5, 9, 10 and 11.

Meanwhile, the user may select one control option among the plurality of control options included in the UI for overall control. Here, the one selected control option may be received as the second user input.

If the second user input is received, the processor 130 may identify the drying course based on the washing course selected by the user and the control option selected by the user.

The dryer 200 may be operated in a plurality of drying courses, and the processor 130 may identify the drying course corresponding to the control option selected by the user among the plurality of drying courses. For example, if the user selects the energy saving control, the processor 130 may identify the drying course having lower power consumption. In addition, if the user selects the time saving control, the processor 130 may identify the drying course having less time required to complete the course. In addition, if the user selects standard control (for example the general control), the processor 130 may identify the predetermined course (or standard course). Here, the processor 130 may identify the drying course in consideration of the washing course selected by the user in addition to the control option selected by the user. If only the control option selected by the user is considered, the drying course may not be properly associated with the washing course and the laundry may thus be difficult to maintain a predetermined quality. Therefore, the processor 130 may identify the drying course in consideration of both the washing course selected by the user and the control option selected by the user. Even if the control options selected by the user are the same, the identified drying course may be different based on the washing course selected by the user. Specific embodiments related to this case are described below with reference to FIGS. 18 through 25.

Meanwhile, the processor 130 may control generation of information corresponding to the identified drying course. Here, the information corresponding to the identified drying course may be described as drying course information. Here, the drying course information may include at least one of identification information corresponding to the identified drying course, a control command or a detailed option of the identified drying course. Here, the identification information corresponding to the drying course may indicate a unique number specifying the identified drying course among the plurality of drying courses. Here, the control command may indicate a command to start the drying course. Here, the detailed option may indicate the detailed function of the identified drying course. For example, the detailed option may include at least one of time, drying temperature or rotational speed, and may further include at least one of power consumption or drying degree as additional information.

The processor 130 may control transmission of the information (drying course information) corresponding to the generated drying course. For example, the processor 130 may control the generated drying course information to be transmitted to the server 300. As another example, the processor 130 may control the generated drying course information to be directly transmitted to the dryer 200. As another example, the processor 130 may control the generated drying course information to be transmitted to the terminal device 400.

Meanwhile, the plurality of control options may be the control options applicable to both the washing course of the washing machine 100 and the drying course of the dryer 200.

The control option may indicate the user's control manner in the overall control of the washing machine 100 and dryer 200. As described above, the energy saving control, the general control, the time saving control and the like may be the control options applicable to the washing machine 100 and the dryer 200. However, some of the control options may be inapplicable based on each course of the washing machine 100 and that of the dryer 200. For example, the time saving control option may be inapplicable to a specific course (e.g., "boiling-washing course") of the washing machine. The reason is that a minimum amount of time may be required to perform the specific course.

The processor 130 may determine whether the plurality of control options is applicable to the washing course selected by the user. In addition, based on its determination result, the processor 130 may control the UI for overall control to only include and display the control option applicable to the washing course selected by the user among the plurality of control options. According to an embodiment, the processor 130 may control display of all of the plurality of control options, the control option applicable to the washing course selected by the user, and the inapplicable control option. For example, the processor 130 may control the inapplicable control option to be displayed in a different color or control a separate object to be displayed at a position where the inapplicable control option is displayed. A detailed description related thereto is described below with reference to FIG. 10.

Meanwhile, the processor 130 may obtain control information on the selected washing course based on the selected control option, and obtain the drying course of the dryer 200 and control information on the drying course based on the control option, based on the obtained control information.

The selected washing course may indicate the washing course received by the first user input. The selected washing course may be in a state in which its basic detailed option is automatically determined. The selected control option may indicate the control option received by the second user input. The selected washing course based on the selected control option may have a plurality of meanings.

For example, "the selected washing course based on the selected control option" may indicate the washing course received by the first user input. This case may correspond to an embodiment in which the existing washing course is maintained as it is based on the control option selected by the user.

As another example, "selected washing course based on the selected control option" may indicate a washing course in which some of the detailed options of the washing course received by the first user input are determined. In this case, if the user selects the washing course, its detailed option is yet to be determined, and if the user selects the control option, the detailed option of the washing course may be finally determined. Therefore, the washing course received by the first user input may indicate the washing course the detailed option of which is yet to be specifically determined, and the "selected washing course based on the selected control option" may indicate the washing course the detailed option of which is determined.

As another example, "the selected washing course based on the selected control option" may indicate the washing course in which the detailed option of the washing course received by the first user input is changed. In this case, for the washing course received by the first user input, a predetermined basic detailed option may be automatically determined. For example, if a standard washing course is selected, its detailed option may be predetermined as a default value. Here, if the second user input is received, the predetermined basic detailed option may be partially changed based on the control option selected by the user. Therefore, the washing course received by the first user input may indicate the washing course the detailed option of which is basically determined, and the "selected washing course based on the selected control option" may indicate the washing course at least one detailed option of which is changed by the second user input.

To comprehensively indicate a variety of meanings, "the selected washing course based on the selected control option" may be described as "the washing course corresponding to the selected control option" or "the washing course including its detailed option corresponding to the selected control option."

Here, the control information may indicate at least one of time information or power consumption information. In detail, the control information on the washing (or drying) course may indicate at least one of the time information required to complete the washing (or drying) course or the information on the amount of power consumed to complete the washing (or drying) course.

The processor 130 may identify "the selected washing course based on the selected control option" and obtain the time information or power consumption information on the identified washing course. In addition, the processor 130 may identify the drying course of the dryer 200 based on the obtained control information on the washing course. In detail, the processor 130 may obtain at least one threshold value corresponding to the control option selected by the user. Here, the at least one threshold value corresponding to the control option may indicate a value that serves as a criterion for identifying a specific washing course or a specific drying course in performing the control option.

According to an embodiment, if the control option is the energy saving control, the at least one threshold value may indicate at least one of minimum power consumption to satisfy the quality or maximum power consumption to save the energy. Therefore, the amount of power consumed to perform both the washing course and the drying course may have to be the minimum power consumption or more and less than the maximum power consumption. The processor 130 may determine at least one of the washing course or the drying course in consideration of the minimum power consumption and the maximum power consumption.

According to another embodiment, if the control option is the time saving control, the at least one threshold value may include at least one of minimum time for satisfying the quality or maximum time for saving the time. Here, the maximum time may be predetermined time or time directly input (or received) by the user. Therefore, the time required to perform both the washing course and the drying course may have to be the minimum time or more and less than the maximum time. The processor 130 may determine at least one of the washing course or the drying course in consideration of the minimum time and the maximum time.

A detailed description of using the control information and the like is described below with reference to FIGS. 20 through 25.

Meanwhile, the processor 130 may control the display 110 to display a UI including the control information on the washing course and the control information on the drying course.

The processor 130 may control generation of the UI for overall control including the obtained control information on the washing course and the obtained control information on the drying course, and may control the generated UI for overall control to be displayed on the display 110. For example, the processor 130 may control the control information on the washing course and the drying course to be provided to the user by controlling operation time information and power consumption information to be displayed according to a control option. A detailed description related thereto is described below with reference to FIGS. 6, 7, 8 and 11.

Meanwhile, the processor 130 may control guide information recommending at least one control option among the plurality of control options included in the UI to be provided based on a user history related to at least one of the washing machine 100 or the dryer 200.

The processor 130 may control storage of the user usage history.

According to an embodiment, the processor 130 may identify which control option the user recently selects or which control option the user uses the most, based on the user usage history.

According to another embodiment, the processor 130 may determine how the detailed option is changed if the user does not select the control option and performs the general washing and drying. For example, the processor 130 may control storage of information that the user reduces the number of rinsing from default three times to two times in the standard washing course. The processor 130 may determine that a user behavior of reducing the number of rinsing is to save the time. In addition, the processor 130 may control storage of information that the user lowers the drying temperature from default 70 degrees to 60 degrees in the drying course. The processor 130 may determine that a user behavior of lowering the drying temperature is to save the energy. The processor 130 may analyze this user behavior pattern to identify the control option corresponding to a value on which the user puts importance. In addition, the processor 130 may control the guide information recommending the identified control option among the plurality of control options to be provided to the user. Here, the guide information may indicate a description phrase or an emphasis object notifying that the specific control option is recommended in the UI for overall control. A detailed description related thereto is described below with reference to FIG. 9.

Meanwhile, the processor 130 may determine an order in which the plurality of control options included in the UI are displayed based on a user history related to at least one of the washing machine 100 or the dryer 200.

The processor 130 may control storage of the user behavior pattern, and obtain a usage frequency of each of the plurality of control options based on the stored user behavior pattern. In addition, the processor 130 may control generation of the UI for overall control for a control option having high usage frequency to be displayed on a top line. That is, as the usage frequency is higher, the control option is displayed on an upper line, and the user may thus easily select the control option frequently used. Meanwhile, according to an embodiment, the processor 130 may control storage of the behavior pattern in which the user rather than the control option directly changes the detailed option, and may identify the control option on which the user puts the most value based on the stored behavior pattern. In addition, the processor 130 may determine the order of the control options in consideration of a value corresponding to the user behavior of changing the detailed option, and control the UI for overall control in the determined order of the control options to be displayed.

Meanwhile, the control option may include an option for at least one of energy saving control, general control or time saving control, control power corresponding to the energy saving control may be determined based on a user history related to at least one of the washing machine 100 or the dryer 200, and control time corresponding to the time saving control may be determined based on a user history related to at least one of the washing machine 100 or the dryer 200.

According to an embodiment, the control power corresponding to the energy saving control (control option selected by the user) may indicate at least one threshold value corresponding to the control option. As described above, the processor 130 may determine at least one of the washing course or the drying course based on the control option selected by the user. In addition, the at least one threshold value may be used in a determination operation. For example, the processor 130 may identify a combination (group of a specific washing course and a specific drying course) in which a total value of the power consumption of the washing course and the drying course is the minimum power consumption or more and less than the maximum power consumption.

Here, the minimum power consumption and the maximum power consumption may be determined by the user history. For example, it is possible to obtain the minimum power consumption, the maximum power consumption and average power consumption by analyzing a plurality of washing and drying usage patterns used by the user during a predetermined period. In addition, the processor 130 may identify the control power corresponding to the energy saving control based on the obtained power consumption. In addition, the processor 130 may determine at least one of the washing course or the drying course, suitable for the energy saving control selected by the user by using the identified control power as the threshold value.

According to another embodiment, the control time corresponding to the time saving control (control option selected by the user) may indicate at least one threshold value corresponding to the control option. As described above, the processor 130 may determine at least one of the washing course or the drying course based on the control option selected by the user. In addition, the at least one threshold value may be used in the determination operation. For example, the processor 130 may identify a combination (group of a specific washing course and a specific drying course) in which a total value of the time required for the washing course and the drying course is the minimum time or more and less than the maximum time.

Here, the minimum time and the maximum time may be determined by the user history. For example, it is possible to obtain the minimum time, the maximum time and an average time by analyzing a plurality of washing and drying usage patterns used by the user during the predetermined period. In addition, the processor 130 may identify the control time corresponding to the energy saving control based on the obtained time. In addition, the processor 130 may determine at least one of the washing course or the drying course, suitable for the time saving control selected by the user by using the identified control time as the threshold value.

Meanwhile, if the drying course of the dryer 200 is identified, the processor 130 may identify the detailed option of the drying course based on the selected control option, and control information including the detailed option of the identified specific drying course to be transmitted to the dryer 200.

According to an embodiment, the plurality of drying courses may each have the detailed option determined as a default value. Therefore, the identified drying course may have the detailed option determined as the default value. Here, the processor 130 may control a change of the detailed option of the drying course determined as the default value based on the control option selected by the user. Here, the changed detailed option may be described as the determined (or identified) detailed option.

According to another embodiment, the plurality of drying courses may each only have some determined detailed options among the plurality of detailed options, and the other detailed option yet to be determined. For example, in a low-noise course, the drying course may only have a rotational speed determined to be slow, and have a drying temperature yet to be determined. Here, if the identified drying course is the low-noise course, the processor 130 may determine the detailed option (drying temperature) yet to be determined based on the control option selected by the user.

The processor 130 may control the generation of the drying course information including the identified drying course and the determined detailed option, and control the generated drying course information to be transmitted to the dryer 200.

Meanwhile, the processor 130 may control the information corresponding to the identified drying course to be transmitted to the dryer 200 through the external server 300.

Here, the information on the identified drying course may be described as the drying course information. The processor 130 may control the generated drying course information to be transmitted to the external server 300. In addition, the server 300 may transmit the drying course information received by the dryer 200 corresponding to (or mapped to) the washing machine 100. Meanwhile, a detailed description of an embodiment using the server 300 is described below with reference to FIGS. 15 through 20.

Meanwhile, the processor 130 may control the information corresponding to the identified drying course to be transmitted to the dryer 200 through the server 300 and the terminal device 400. A detailed description related thereto is described below with reference to FIGS. 28 and 29.

According to an embodiment of the disclosure, the overall control manner of the washing machine 100 and the dryer 200 is described as receiving the washing course by the first user input and receiving the control option by the second user input.

Through the overall controlling method of the corresponding embodiment, a control manner suitable for a user need may be applied to at least one of the washing machine 100 or the dryer 200. The washing course selected by the user may be changed based on the control option, and the drying course and the detailed option of the drying course may also be changed based on the control option. The operation of the dryer 200 may be different depending on which washing course and which control option are selected, which may meet the various user needs.

In addition, the overall controlling method may determine the washing course and the drying course using the user history in order to satisfy the user need. Therefore, the user may be provided with the controlling method inconsistent and fitting the user usage pattern.

Meanwhile, the above description describes that the washing machine 100 performs the determination operation of determining the washing course and the drying course. However, according to an embodiment, the determination operation may be performed by at least one of the dryer 200, the server 300 or the terminal device 400 instead of the washing machine 100.

Meanwhile, the above description describes that the washing course is received by the first user input and the control option is received by the second user input. However, according to another embodiment, the overall controlling method may be implemented in the form of determining the washing course and the drying course by receiving only the second user input without the first user input. In detail, the drying course and the washing course may be determined based on the control option received by the second user input.

In the overall controlling method according to another embodiment, the drying course may be received by the first user input and the control option may be received by the second user input. In addition, in the overall controlling method, the detailed option of the drying course, the washing course, the detailed option of the washing course and the like may be determined based on the received drying course and the received control option. In this case, the washing course may be first performed and followed by the drying course.

Meanwhile, the above description illustrates and describes only a simple configuration configuring the washing machine 100, and various configurations may be further provided in case of its implementation. This case is described below with reference to FIG. 2.

Figure 2:
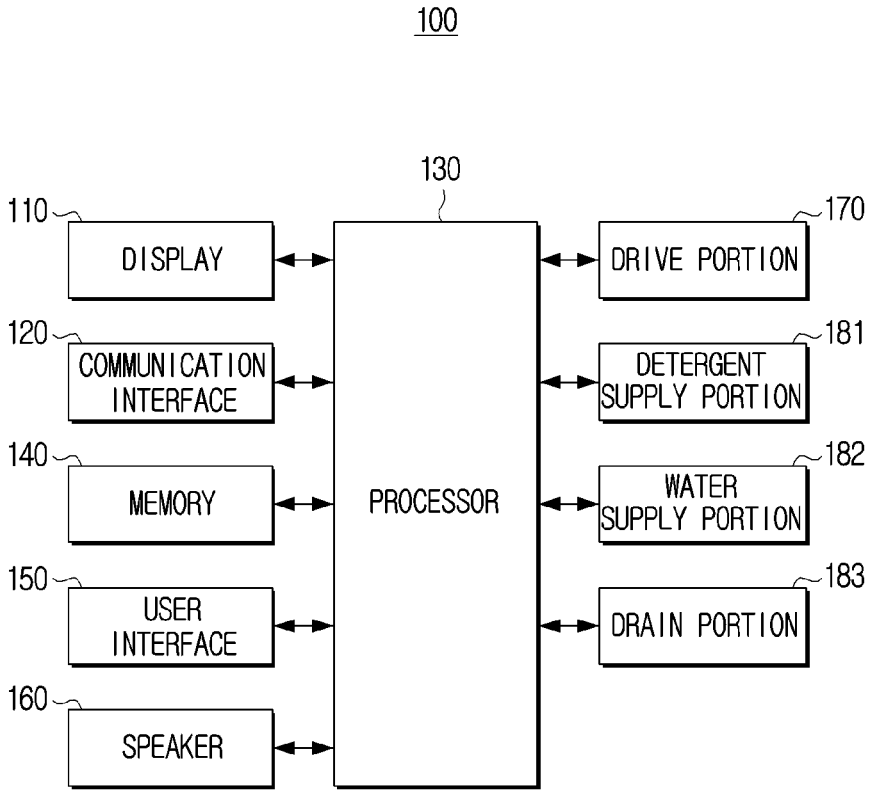
FIG. 2 is a block diagram showing a specific configuration of the washing machine of FIG. 1.

FIG. 2 is a block diagram showing a specific configuration of the washing machine of FIG. 1.

Referring to FIG. 2, the washing machine 100 may include the display 110, the communication interface 120, the processor 130, a memory 140, a user interface 150, a speaker 160, a drive portion 170, a detergent supply portion 181, a water supply portion 182, and a drain portion 183.

Meanwhile, the description omits redundant description of the same operations as described above among the operations of the display 110, the communication interface 120, and the processor 130.

The memory 140 may be implemented as an internal memory such as a read-only memory (ROM, e.g., electrically erasable programmable read-only memory (EEPROM)) or a random access memory (RAM), included in the processor 130, or as a memory separate from the processor 130. In this case, the memory 140 may be implemented in the form of a memory embedded in the washing machine 100 or in the form of a memory removable from the washing machine 100, based on a data storing purpose. For example, data for driving the washing machine 100 may be stored in the memory embedded in the washing machine 100, and data for the extended function of the washing machine 100 may be stored in the removable memory in the washing machine 100.

Meanwhile, the memory embedded in the washing machine 100 may be implemented as at least one of a volatile memory (e.g., dynamic RAM (DRAM), static RAM (SRAM) or synchronous dynamic RAM (SDRAM)), a non-volatile memory (e.g., one time programmable ROM (OTPROM)), programmable ROM (PROM), erasable and programmable ROM (EPROM), electrically erasable and programmable ROM (EEPROM)), a mask ROM, a flash ROM, a flash memory (e.g., NAND flash or NOR flash or the like), a hard drive or a solid state drive (SSD); and the memory removable from the washing machine 100 may be implemented as a memory card (e.g., compact flash (CF), secure digital (SD)), micro secure digital (Micro-SD), mini secure digital (mini-SD), extreme digital (xD), multi-media card (MMC) or the like) or an external memory which may be connected to a universal serial bus (USB) port (e.g., USB memory), etc.

The user interface 150 may be implemented in a device such as a button, a touch pad, a mouse and a keyboard, or may be implemented in a touch screen capable of also performing an operation input function in addition to the above-described display function. Here, the button may be various types of buttons such as a mechanical button, a touch pad, a wheel and the like, formed in any region such as a front surface portion, a side surface portion, a rear surface portion and the like, of a body appearance of the washing machine 100.

The speaker 160 may be a component outputting not only various audio data processed by an input/output interface, but also various notification sounds or voice messages.

The drive portion 170 may include a drive motor. The drive portion 170 may rotate a drum accommodating the laundry. In detail, the drive portion 170 may rotate the drum accommodating the laundry by driving the drive motor. The drive motor of drive portion 170 may receive power and generate a drive force, and the drive portion 170 may transmit the generated drive force only to the pulsator or to both the drum and the pulsator simultaneously. In addition, the drive portion 170 may receive a drive control signal controlled to be generated by the processor 130 and drive the detergent supply portion 181 for the detergent contained in the detergent supply portion 181 to be supplied to the drum accommodating the laundry. In addition, the drive portion 170 may receive the drive control signal controlled to be generated by the processor 130 and drive the water supply portion 182 for washing water to be supplied into the drum, or drive the drain portion 183 for the washing water contained in the drum to be discharged from the washing machine 100.

The detergent supply portion 181 may supply the detergent stored in a detergent storage to the drum accommodating the laundry as the drive portion 170 is driven. The detergent supply portion 181 may be connected to a detergent pipe. If a water supply valve of the water supply portion 182 is opened and water is supplied to the water supply pipe, the detergent supplied from the detergent supply portion 181 may be mixed with water and dissolved therein. In addition, water mixed with the dissolved detergent may be supplied to the drum accommodating the laundry through the water supply pipe.

The water supply portion 182 may include the water supply pipe connected to an external water source and a water supply valve to open and close the water supply pipe. If the water supply pipe is opened, water may be supplied from the external source through the water supply pipe.

The drain portion 183 may include a pump, a first drain pipe and a second drain pipe. The pump may suck water from the drum. One end of the first drain pipe may be connected to a lower portion of the drum, and the other end may be connected to the pump to move water in the drum to the pump. One end of the second drain pipe may be connected to the pump, and the other end may extend outside a body of the washing machine 100 for water from the drum to be discharged outside. Therefore, if the pump is operated, water from the drum may be discharged outside the washing machine 100 through the first and second drainage pipes.

Meanwhile, the washing machine 100 may further include a drying portion (not shown). The drying portion (not shown) may include a heater and a blower fan. In addition, the drying portion (not shown) may apply heat to the drum at a predetermined temperature using the heater and the blower fan to dry the laundry. However, the drying portion (not shown) is not an essential component for the washing machine 100, and according to an embodiment, the drying portion (not shown) may not be included in the washing machine 100.

Figure 3:
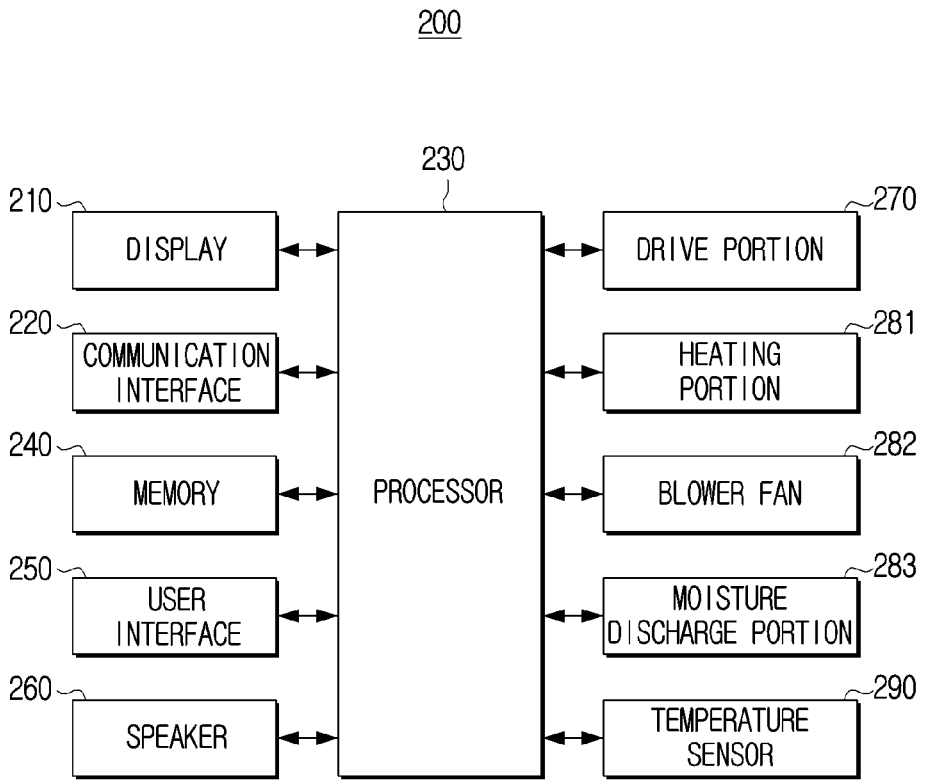
FIG. 3 is a block diagram showing a dryer according to an embodiment of the disclosure.

FIG. 3 is a block diagram showing a dryer according to an embodiment of the disclosure.

Referring to FIG. 3, the dryer 200 may include a display 210, a communication interface 220, a processor 230, a memory 240, a user interface 250, a speaker 260, a drive portion 270, a heating portion 281, and a blower fan 282, a moisture discharge portion 283 and a temperature sensor 290.

The dryer 200 may be a device drying wet laundry. In detail, dryer 200 may evaporate moisture using heat or separate moisture from the laundry using a physical force.

Meanwhile, the descriptions of the display 210, the communication interface 220, the processor 230, the memory 240, the user interface 250 and the speaker 260 may correspond to the descriptions on the configurations of the display 110, the communication interface 120, the processor 130, the memory 140, the user interface 150 and the speaker 160 of FIGS. 1 and 2, and redundant descriptions thereof are thus omitted.

The processor 230 may perform overall control operation of the dryer 200. In detail, the processor 230 may function to control the overall operation of the dryer 200.

The processor 230 may control drying course information to be received through the communication interface 220, and control information related to the dryer 200 to be transmitted to the washing machine 100, the server 300 or the terminal device 400.

The drive portion 270 may include a drive motor, and the drive portion 270 may drive the heating portion 281 and the blower fan 282 using the drive motor. In detail, the drive motor of the drive portion 270 may receive power and generate a drive force, and the drive portion 270 may transmit the generated drive force to the heating portion 281 and the blower fan 282. The drive portion 270 may receive a drive control signal generated by the processor 230 and drive the heating portion 281 to supply a heat source to the drum. In addition, the drive portion 270 may receive the drive control signal generated by the processor 230 and drive the blower fan 282 to circulate air inside the drum supplied to which the heat source is supplied.

The heating portion 281 may be implemented by a gas heat source supply manner or an electric heat source supply manner. The gas manner may indicate a manner in which air is heated using gas. The electric manner may indicate a manner in which air is heated using electricity. The electric manner may be a manner using at least one of a heater or a heat pump. The heater may use a manner in which a heat source is supplied using a heating wire or the like. The heat pump may use a manner in which a heat source is supplied using a refrigerant. The heat pump may include an evaporator, a compressor and a condenser.

The blower fan 282 may indicate a fan purifying hot air supplied to the drum of the dryer 200. In detail, the blower fan 282 may receive the drive control signal from the drive portion 270 and drive the fan.

The moisture discharge portion 283 may discharge moisture inside the dryer 200. The dryer 200 may have a vent type (hot air exhaust manner) or a condensing type (hot air dehumidification manner) based on a moisture discharging manner.

The temperature sensor 290 may detect temperature inside the dryer 200. The temperature sensor 290 may include at least one of a first temperature sensor detecting temperature of air in the drum inside the dryer 200 or a second temperature sensor detecting temperature of the refrigerant inside the dryer 200. The temperature data detected by the temperature sensor 290 may be transmitted to the processor 230, and the processor 230 may control an operation of the dryer 200 based on the detected temperature data.

Figure 4:
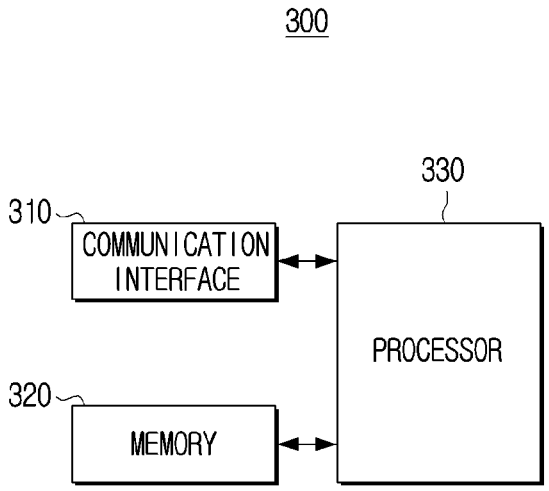
FIG. 4 is a block diagram showing a server according to an embodiment of the disclosure.

FIG. 4 is a block diagram showing a server according to an embodiment of the disclosure.

Referring to FIG. 4, the server 300 may include a communication interface 310, a memory 320 and a processor 330. Meanwhile, the configurations of the communication interface 310, the memory 320 and the processor 330 may correspond to the configurations of the communication interface 120, the memory 140 and the processor 130 of FIGS. 1 and 2, and redundant descriptions thereof are thus omitted.

The processor 330 may perform overall control operation of the server 300. In detail, the processor 130 may function to control the overall operation of the server 300.

Figure 5:
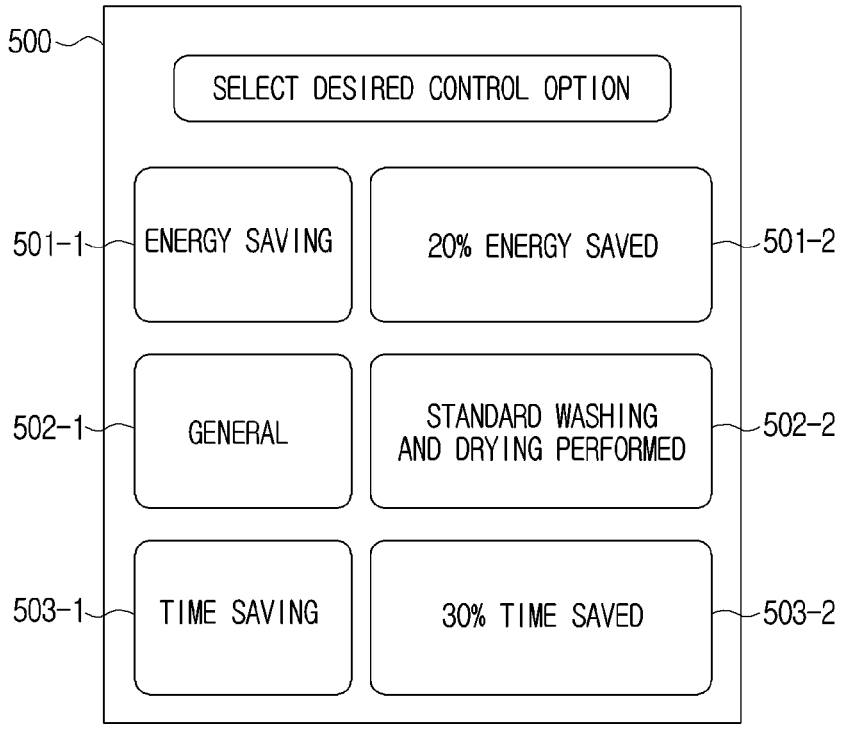
FIG. 5 is a diagram showing a user interface (UI) for overall control of the washing machine and the dryer according to an embodiment.

FIG. 5 is a diagram showing a user interface (UI) for overall control of the washing machine and the dryer according to an embodiment.

Referring to FIG. 5, the washing machine 100 may provide a UI 500 for overall control. In detail, the washing machine 100 may display the UI 500 for overall control on the display 110. In addition, the UI 500 for overall control may include a plurality of control options 501-1, 502-1 and 503-1, and description regions 501-2, 502-2 and 503-2 respectively corresponding to the plurality of control options.

Here, the UI 501-1 corresponding to the "energy saving" control option may indicate a control option in which the washing machine 100 and the dryer 200 are controlled to consume the low power. In addition, the UI 501-2 may include information including energy saving degree.

In addition, the UI 502-1 corresponding to the "general" control option may indicate a control option in which the washing machine 100 and the dryer 200 are controlled to be operated in the predetermined course. In addition, the UI 502-2 may include a description of the predetermined course.

Here, the UI 502-1 corresponding to the "time saving" control may indicate a control option in which the washing machine 100 and the dryer 200 are controlled to require the minimum time. In addition, the UI 503-2 may include at least one of time saving degree or an operation time.

Here, the plurality of UIs 501-1, 502-1 and 503-1 may be described as the plurality of control options.

Figure 6:
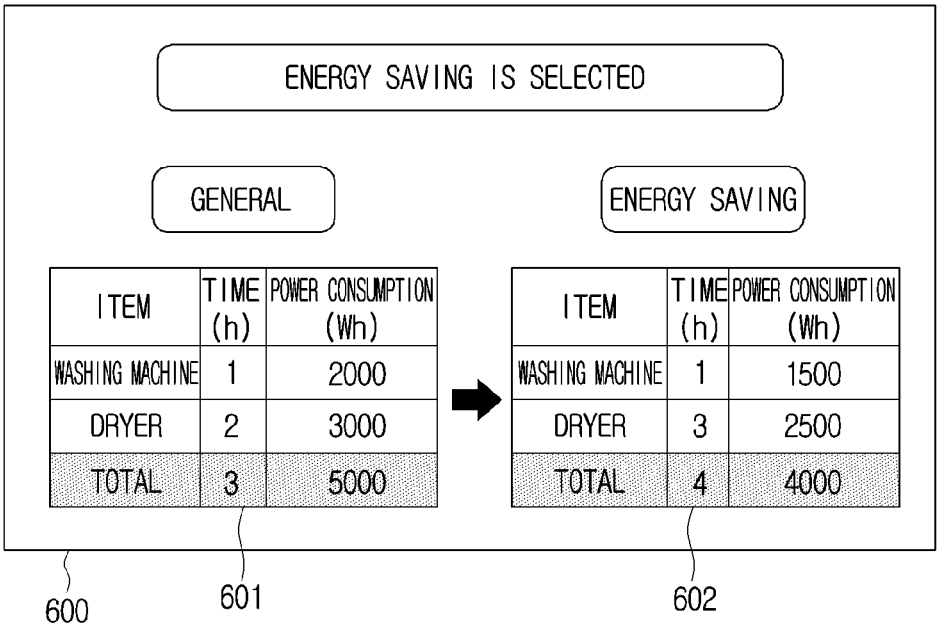
FIG. 6 is a diagram showing a UI displayed after one control option is selected from the UI for overall control according to an embodiment.

FIG. 6 is a diagram showing a UI displayed after one control option is selected from the UI for overall control according to an embodiment.

Referring to FIG. 6, the washing machine 100 may display a new UI 600 for overall control based on one control option selected from the UI 500 for overall control. In order to distinguish the UI 600 for overall control from the UI 500 for overall control of FIG. 5, the UI 500 for overall control may be described as the UI for overall control selection, and the UI 600 for overall control may be described as the UI for overall control result. Here, it is assumed that the user selects the energy saving control among the plurality of control options.

Based on the control option selected by the user, the washing machine 100 may identify the washing course and drying course. In addition, the washing machine 100 may obtain the control information on the identified washing course and the control information on the identified drying course. Here, the control information may indicate at least one of the time information or the power consumption information. The UI 600 for overall control may include at least one of the control information on the washing machine 100, the control information on the dryer 200 or the control information on the washing machine 100 and the dryer 200.

The UI 600 for overall control may include a table 601 displaying the control information corresponding to the general control option and a table 602 displaying the control information corresponding to the energy saving control option. In case that both the table 601 and the table 602 are displayed, the user may easily understand how much time or how much power consumption is changed compared to the general control option.

Meanwhile, according to an embodiment, the UI 600 for overall control may include only the table 602.

Figure 7:
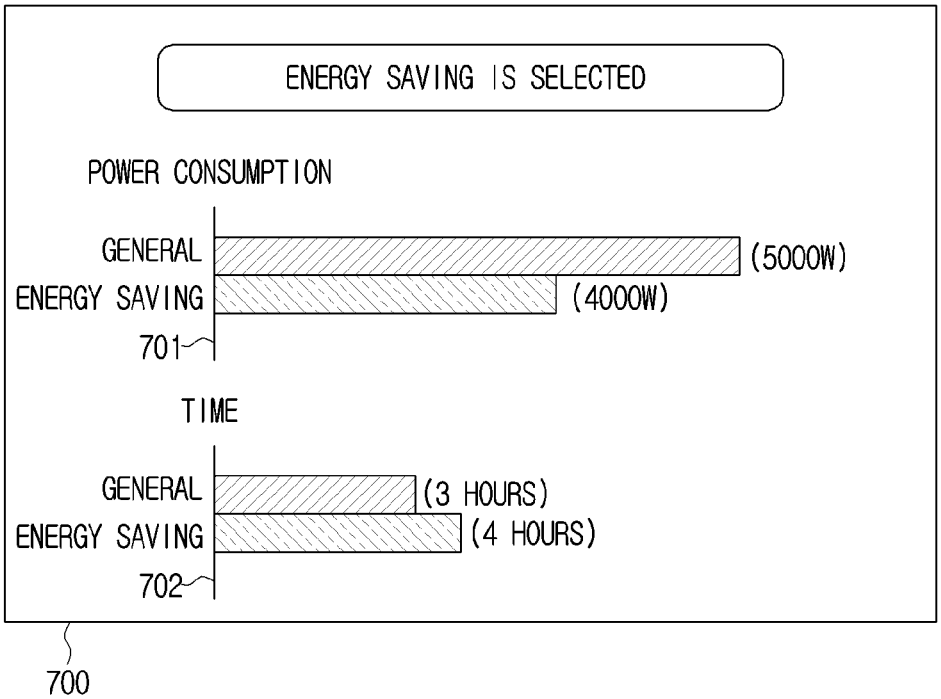
FIG. 7 is a diagram showing another UI displayed after one control option is selected from the UI for overall control according to another embodiment.

FIG. 7 is a diagram showing another UI displayed after one control option is selected from the UI for overall control according to another embodiment.

Referring to FIG. 7, the washing machine 100 may display a new UI 700 for overall control based on one control option selected from the UI 500 for overall control. Here, it is assumed that the user selects the energy saving control among the plurality of control options.

The UI 700 for overall control may include at least one of a graph 701 comparing the power consumption of the general control option and the energy saving control option with each other or a graph 702 comparing the time of the two options with each other. According to an embodiment, if the energy saving control option is selected, the washing machine 100 may display only the graph 701 comparing the power consumption of the two options with each other.

The graphs 701 and 702 may be shown in a horizontal bar shape, and may include numerical information (e.g., "5000 W," "4000 W," "3 hours" and "4 hours").

However, according to an embodiment, the UI 700 for overall control may include various types of graphs other than the horizontal bar graph.

FIG. 8 is a diagram showing another UI displayed after one control option is selected from the UI for overall control according to another embodiment.

Referring to FIG. 8, the washing machine 100 may display a new UI 800 for overall control based on one control option selected from the UI 500 for overall control. Here, it is assumed that the user selects the energy saving control among the plurality of control options.

The UI 800 for overall control may include a table 801 displaying the control information corresponding to the general control option and a table 802 displaying the control information corresponding to the energy saving control option. Here, the control information included in the tables 801 and 802 may be at least one of the operation time information, the power consumption information, course information or detailed option information.

The course information may indicate information on which mode each of the washing machine 100 and the dryer 200 is operated. The detailed option information may indicate details of the operation mode of the washing machine 100 and the dryer 200. The detailed option of the washing course may include at least one of washing temperature, the number of rinsing or dehydration intensity, and the detailed option of the drying course may include at least one of the drying temperature or the number of rotations.

The UI 800 for overall control may include the detailed option for the washing course and the detailed option for the drying course. Therefore, the user may easily understand how the detailed function differs based on the selected control option.

Figure 9:
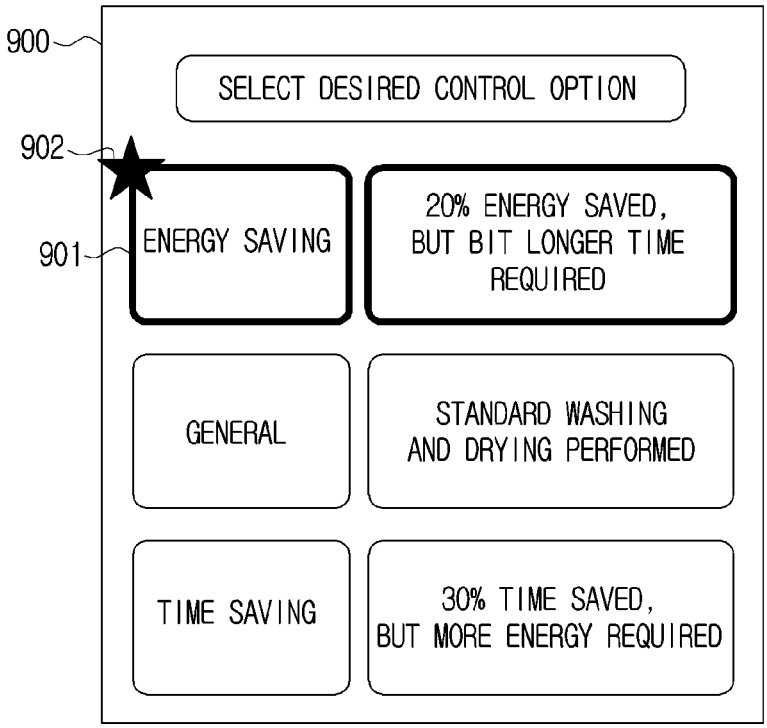
FIG. 9 is a diagram showing another UI displayed after one control option is selected from the UI for overall control according to another embodiment.

FIG. 9 is a diagram showing another UI displayed after one control option is selected from the UI for overall control according to another embodiment.

Referring to FIG. 9, the washing machine 100 may provide a UI 900 for overall control. The UI related to the control option is already described with respect to FIG. 5, and redundant description thereof is thus omitted.

The UI 900 for overall control may include the plurality of control options. Here, the washing machine 100 may display guide UIs 901 and 902 on at least one control option among the plurality of control options. The guide UIs 901 and 902 may be UIs for inducing the user's selection. The washing machine 100 may analyze the user usage history of the washing machine 100 and the dryer 200, thereby identifying a recommended control option based on at least one of a recently used control option or the most used control option. In addition, the guide UIs 901 and 902 corresponding to the identified recommended control option may be displayed on the UI 900 for overall control.

The guide UI 901 may be a UI in the form of a border displayed at an edge of the control option, and the guide UI 902 may be a UI in the form of a predetermined figure displayed at a corner of the control option. Meanwhile, the description describes that the UI 900 for overall control includes both the guide UI 901 and the guide UI 902 with respect to FIG. 9. However, the UI 900 for overall control may include one guide UI according to an embodiment.

If the guide UIs 901 and 902 are displayed corresponding to the control options, the user may quickly and easily select a control option frequently used based on the guide UI.

Figure 10:
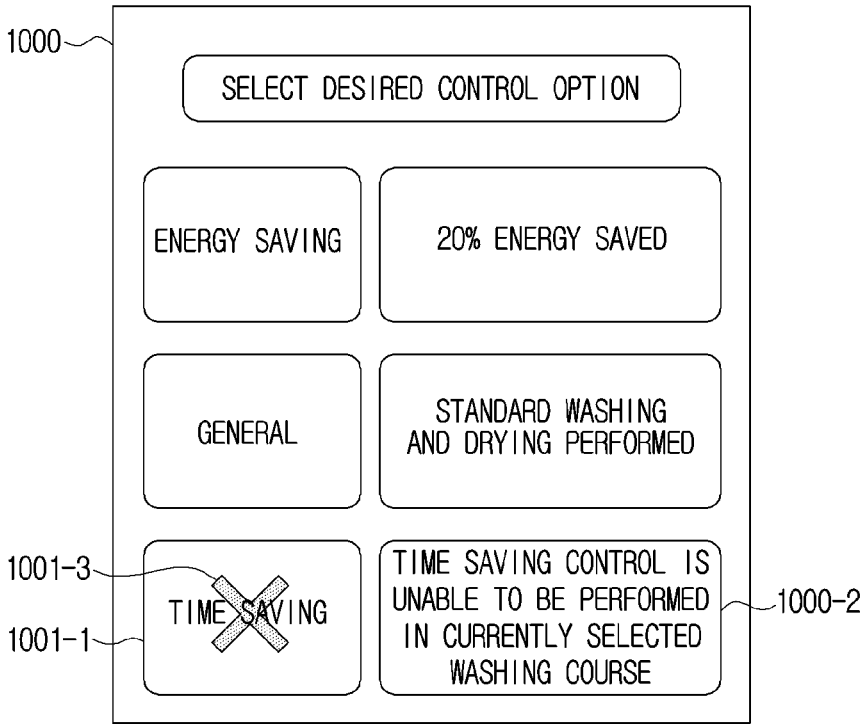
FIG. 10 is a diagram showing another UI displayed after one control option is selected from the UI for overall control according to another embodiment.

FIG. 10 is a diagram showing another UI displayed after one control option is selected from the UI for overall control according to another embodiment.

Referring to FIG. 10, the washing machine 100 may provide a UI 1000 for overall control. The UI related to the control option is already described with respect to FIG. 5, and redundant description thereof is thus omitted.

The washing machine 100 may identify the control option corresponding to the washing course selected by the user. In detail, if the user selects the washing course, the washing machine 100 may identify the control option corresponding to the selected washing course and may generate the UI 1000 for overall control including the identified control option. In addition, the washing machine 100 may provide the generated UI 1000 for overall control.

Here, the UI 1000 for overall control may include the plurality of control options. Here, in controlling the washing machine 100 and the dryer 200, all the control options may be inapplicable to the control course of the washing machine 100. For example, if there are the control options such as the energy saving control, the general control, and the time saving control, the time saving control option may be inapplicable to the specific course (e.g., "boiling-washing course") of the washing machine. The reason is that the minimum amount of time may be required to perform the specific course. Simply saving the time may affect the quality of the washing and the drying, and the washing machine 100 may thus selectively apply the time saving control option for each washing course.

It is assumed that the time saving control option is inapplicable to the washing course selected by the user. The UI 1000 for overall control may display the time saving control option inapplicable to the washing course selected by the user among the plurality of control options, different from the applicable control option.

For example, the washing machine 100 may not include the time saving control option inapplicable to the washing course selected by the user in the UI 1000 for overall control.

As another example, the washing machine 100 may display a time saving control option 1000-1 inapplicable to the washing course selected by the user and a description region 1000-2 corresponding to the option in a color different from a color of the applicable control option.

As another example, the washing machine 100 may display a new object 1001-3 at a position where the time saving control option 1000-1 inapplicable to the washing course selected by the user is displayed. The new object 1001-3 may be an object in a shape for guiding the user that the control option corresponding to the position where the object 1001-3 is displayed is inapplicable.

If the time saving control option inapplicable to the washing course selected by the user is displayed differently from the applicable control option, the user may easily understand whether the control option is applicable or not.

FIG. 11 is a diagram showing another UI displayed after one control option is selected from the UI for overall control according to another embodiment.

Referring to FIG. 11, the washing machine 100 may provide a UI 1100 for overall control including tables 1101, 1102 and 1103 including the control information each corresponding to the plurality of control options.

The UI 600 for overall control shown in FIG. 6 may include the control information corresponding to the selected control option if the user selects the control option. However, the UI 1100 for overall control shown in FIG. 11 may include the control information each corresponding to the plurality of control options before the user selects the control option.

The user may easily check the control information for the selectable control options as the tables 1101, 1102 and 1103.

FIG. 12 is a diagram showing a detailed option for the overall control of the washing machine and the dryer according to an embodiment.

Referring to FIG. 12, the washing machine 100 and the dryer 200 may each include the plurality of courses. Referring to a table 1200, the washing option and the drying option may each be determined based on the washing course and the control option selected by the user.

For example, if the standard course is selected from the washing course and the energy saving control option is selected, the washing machine 100 may determine the washing option as "low water temperature and weak dehydration," the drying course as "standard," and the drying option as "low drying level."

As another example, if the standard course is selected from the washing course and the general control option is selected, the washing machine 100 may determine the washing option as "default option," the drying course as "custom drying," and the drying option as "default option."

As another example, if the standard course is selected from the washing course and the time saving control option is selected, the washing machine 100 may determine the washing option as "strong dehydration," the drying course as "fast drying," and the drying option as "default option."

As another example, if a futon course is selected from the washing course and the energy saving control option is selected, the washing machine 100 may determine the washing option as "low water temperature and weak dehydration," the drying course as "futon," and the drying option as "low drying level."

As another example, if the futon course is selected from the washing course and the general control option is selected, the washing machine 100 may determine the washing option as "default option," the drying course as "futon drying," and the drying option as "default option."

As another example, if the futon course is selected from the washing course and the time saving control option is selected, the washing machine 100 may determine the washing option as "strong dehydration," the drying course as "fast drying," and the drying option as "default option."

Meanwhile, the description only describes the contents of some courses with respect to FIG. 12. However, the washing machine 100 and the dryer 200 may include various courses.

The washing course may include a basic course and an additional course. The basic course may include the standard course, a fast course, a wool/lingerie course, a rinsing and dehydration course and a detergent-free tub cleaning course. The additional course may include the boiling-washing course, a strongest washing, an ultra-saving washing course, a towel course, a futon course, a baby clothes course and an outdoor wear course.

The drying course may include a basic course and an additional course. The basic course may include the standard course, the custom drying, the fast drying, a shirt drying, the futon drying, a towel drying, a delicate clothing drying, a synthetic fiber drying, a wool drying, a sportswear drying and a jeans drying. The additional course may include an air sterilization course, a futon/dust removal course and an internal care course.

FIG. 13 is a diagram showing a detailed option for the overall control of the washing machine and the dryer according to another embodiment.

Referring to FIG. 13, the washing machine 100 and the dryer 200 may each include the plurality of courses. Referring to a table 1300, the washing option and the drying option may each be determined based on the washing course and the control option selected by the user.

For example, if the standard course is selected from the washing course and the energy saving control option is selected, the washing machine 100 may determine the washing option as washing temperature of 30 degrees, two rinsing times and weak dehydration intensity, and the drying option as drying temperature of 40 degrees and slow rotational speed.

For another example, if the standard course is selected from the washing course and the general control option is selected, the washing machine 100 may determine the washing option as washing temperature of 40 degrees, two rinsing times and medium dehydration intensity, and the drying option as drying temperature of 60 degrees and medium rotational speed.

As another example, if the standard course is selected from the washing course and the time saving control option is selected, the washing machine 100 may determine the washing option as washing temperature of 50 degrees, two rinsing times and strongest dehydration intensity, and the drying option as drying temperature of 80 degrees and fast rotational speed.

As another example, if the futon course is selected from the washing course and the energy saving control option is selected, the washing machine 100 may determine the washing option as washing temperature of 30 degrees, three rinsing times, and medium dehydration intensity, and the drying option as drying temperature of 80 degrees and slow rotational speed.

For another example, if the futon course is selected from the washing course and the general control option is selected, the washing machine 100 may determine the washing option as washing temperature of 40 degrees, three rinsing times and strong dehydration intensity, and the drying option as drying temperature of 80 degrees and medium rotational speed.

For another example, if the futon course is selected from the washing course and the time saving control option is selected, the washing machine 100 may determine the washing option as washing temperature of 50 degrees, three rinsing times and strongest dehydration intensity, and the drying option as drying temperature of 80 degrees and fast rotational speed.

FIG. 14 is a diagram showing identification information on a plurality of devices connected to the server.

Referring to FIG. 14, the washing machine 100 and the dryer 200 may be included in one network. Here, the one network may include the Internet of things (IoT) network. The IoT network may include the plurality of home appliances and communicate with each other. A host device managing the IoT network may store at least one of device identification information, a device type or a device user for a plurality of devices included in the IoT network.

Referring to a table 1400, the number of devices used by the first user (user1) may be three, and device identification information on the three devices may be #01, #02 and #03. In addition, the number of devices used by the second user (user2) may be two, and device identification information on the two devices may be #04 and #05.

Figure 15:
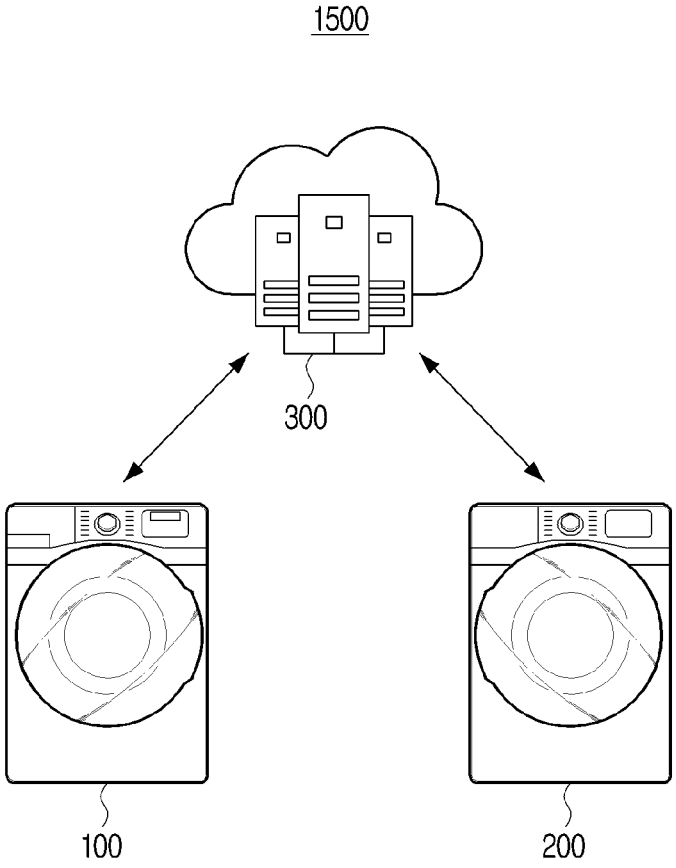
FIG. 15 is a diagram showing that the washing machine and the dryer are controlled through the server according to an embodiment.

FIG. 15 is a diagram showing that the washing machine and the dryer are controlled through the server according to an embodiment.

Referring to FIG. 15, in a system 1500 according to an embodiment, the washing machine 100, the dryer 200 and the server 300 may communicate with one another. In detail, the washing machine 100 and the dryer 200 may communicate with each other through the server 300. Here, the server 300 may indicate a device that communicates with the washing machine 100 and the dryer 200. In detail, the washing machine 100, and the dryer 200 may exchange information with the server 300 using the communication interfaces each included therein.

For example, the server 300 may indicate the external server capable of managing the washing machine 100 and the dryer 200. As another example, the server 300 may indicate the host device of the IoT network including the washing machine 100 and the dryer 200.

Figure 16:
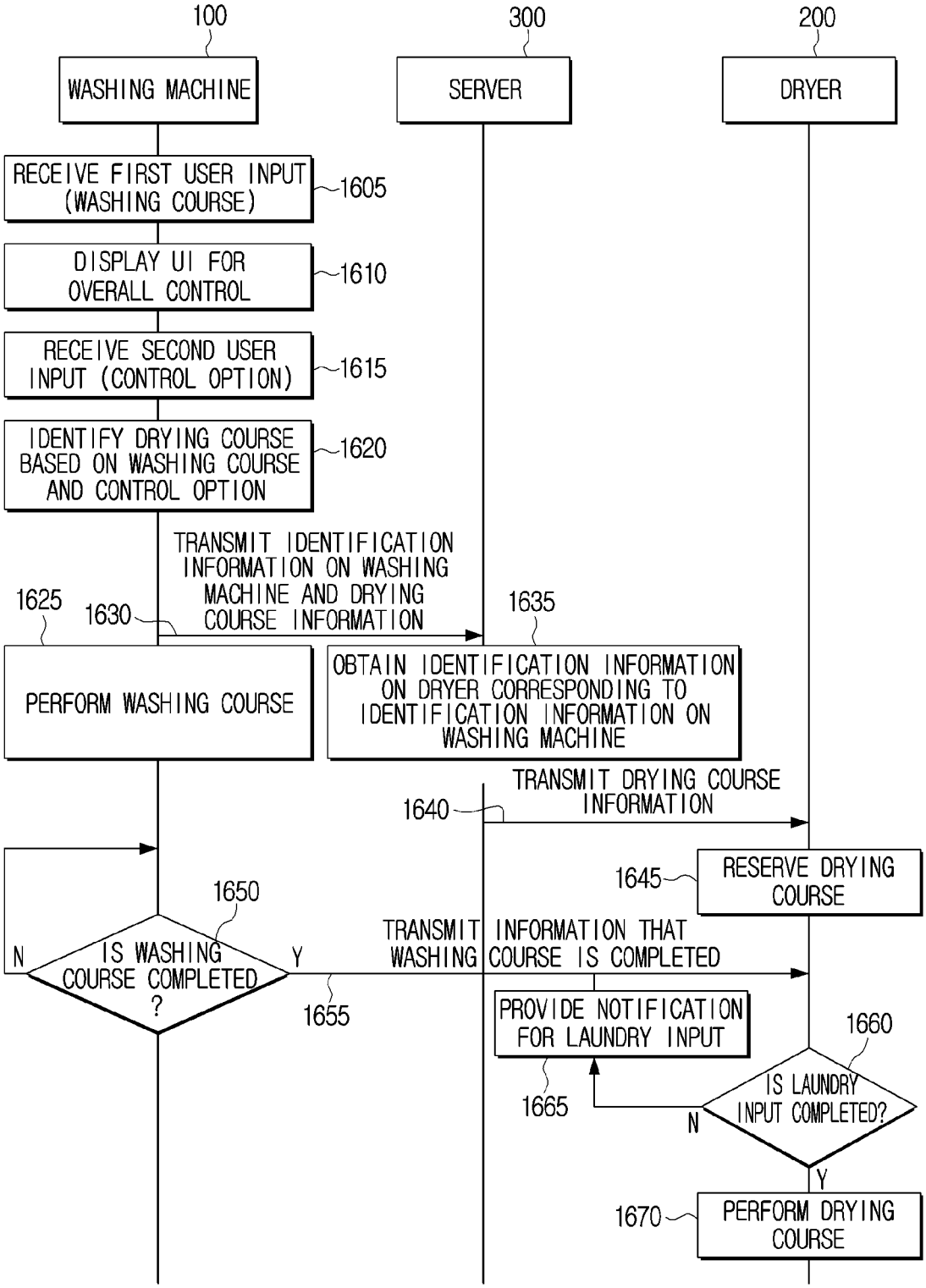
FIG. 16 is a flowchart showing that the overall control is performed using the washing machine, the dryer and the server according to an embodiment.

FIG. 16 is a flowchart showing that the overall control is performed using the washing machine, the dryer and the server according to an embodiment.

Referring to FIG. 16, the washing machine 100 may receive the first user input (washing course) (S1605). If the first user input is received, the washing machine 100 may display the UI for overall control (S1610). The UI for overall control is already described with reference to FIGS. 5, 9, 10 and 11, and redundant description thereof is thus omitted.

The user may select one control option among the plurality of control options included in the UI for overall control. The washing machine 100 may receive the second user input (control option) selected by the user (S1615). Here, the control option may be at least one of the energy saving control, the general control or the time saving control.

In addition, the washing machine 100 may identify the drying course based on the received first user input (washing course) and the second user input (control option) (S1620). The washing machine 100 may generate the drying course information. Here, the drying course information may include the identification information corresponding to the identified drying course, the control command or the detailed option of the identified drying course. Here, the identification information corresponding to the drying course may indicate the unique number specifying the identified drying course among the plurality of drying courses. Here, the control command may indicate the command to start the drying course. Here, the detailed option may indicate the detailed function of the identified drying course.

In addition, the washing machine 100 may perform the washing course (S1625). Here, performing the washing course may indicate executing the control command corresponding to the washing course selected by the first user input. For example, if the first user input is the "standard washing course," the washing machine 100 may start the "standard washing course" in S1625. Here, "perform" may be replaced by expressions such as "starting," "conducting," "executing" or "serving."

In addition, the washing machine 100 may transmit identification information on the washing machine 100 and the identified drying course information (S1630). Here, the identification information on the washing machine 100 may indicate a unique number of the washing machine. Here, the unique number may indicate a number for specifying the washing machine 100 among the plurality of electronic devices.

The server 300 may receive the identification information on the washing machine 100 and the drying course information from the washing machine 100. In addition, the server 300 may obtain identification information on the dryer 200 corresponding to the received identification information on the washing machine (S1635). The server 300 may store table information to which the identification information on the dryer 200 corresponding to the identification information on the plurality of washing machines is mapped. The server 300 may store the plurality of devices included in the specific IoT network in the mapping table. Accordingly, the server 300 may identify in which IoT network the identification information on the washing machine 100 received from the washing machine 100 is included. In addition, if the identification information on the washing machine 100 is received from the washing machine 100, the server 300 may obtain the identification information on the dryer 200 corresponding to the identification information on the washing machine 100, included in the IoT network.

In addition, the server 300 may transmit the drying course information received from the washing machine 100 to the dryer 200 corresponding to the identification information on the identified dryer 200 (S1640).

The dryer 200 may reserve the drying course based on the drying course information received from the server 300 (S1645).

Meanwhile, the washing machine 100 may determine whether the washing course performed in S1625 is completed (S1650). In addition, if the washing course is completed, the washing machine 100 may transmit information that the washing course is completed to the dryer 200 (S1655).

The dryer 200 may determine whether laundry input to the dryer 200 is completed based on the washing course completion information received from the washing machine 100 (S1660). If the laundry is not input to the dryer 200, the dryer 200 may provide the notification for the laundry input (S1665). A manner in which the notification is provided may be at least one of a manner in which predetermined audio data is output through the speaker or a manner in which predetermined image data is output on the display. According to an embodiment, the notification may be provided through the user's terminal device.

Meanwhile, if the laundry input to the dryer 200 is completed, the washing machine 100 may perform the drying course reserved in S1645 (S1670).

Figure 17:
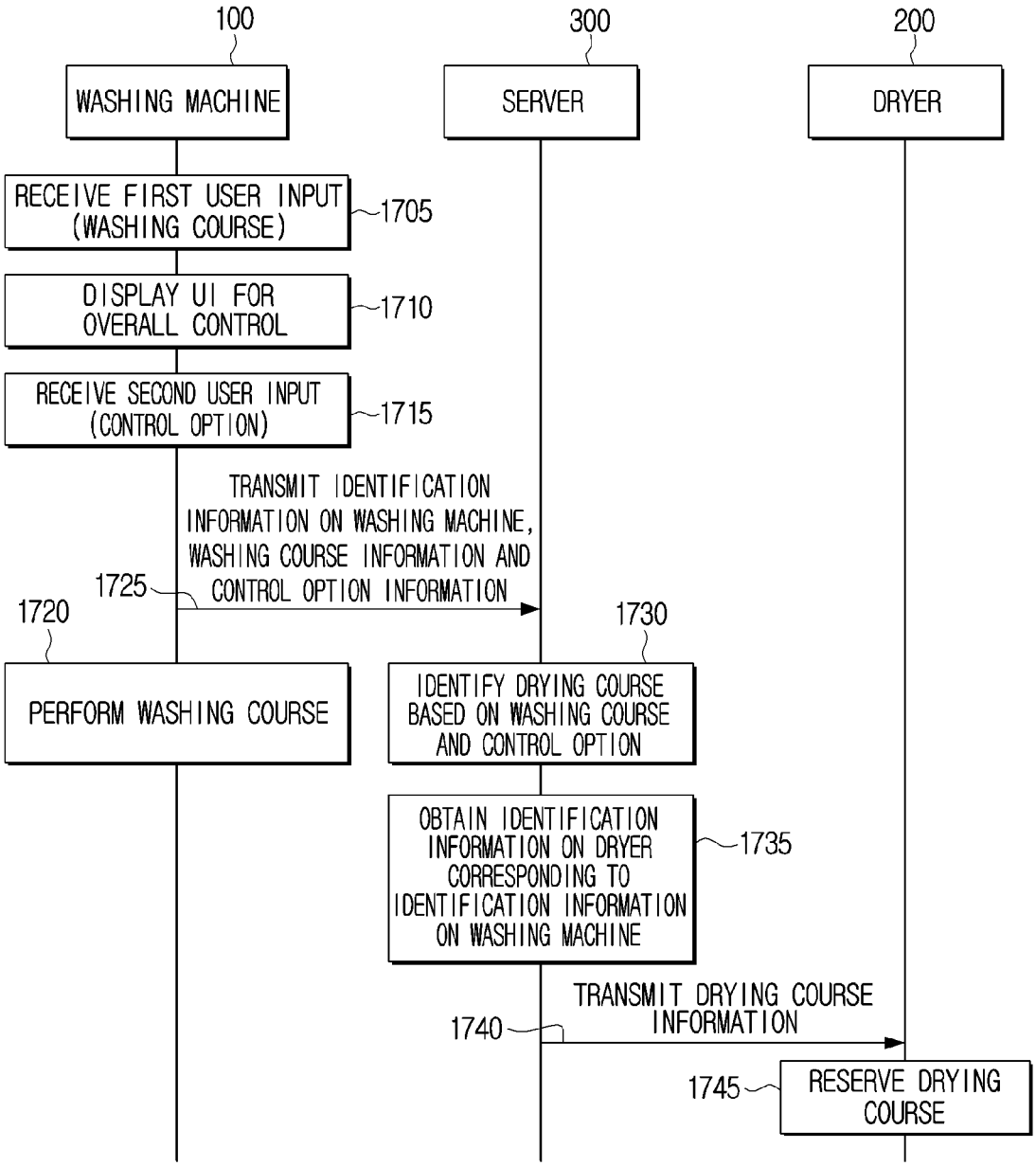
FIG. 17 is a flowchart showing that the overall control is performed using the washing machine, the dryer and the server according to another embodiment.

FIG. 17 is a flowchart showing that the overall control is performed using the washing machine, the dryer and the server according to another embodiment.

Referring to FIG. 17, the washing machine 100 may receive the first user input (washing course) (S1705), may display the UI for overall control (S1710), and may receive the second user input (control option) among the plurality of control options included in the UI for overall control (S1715). S1705, S1710 and S1715 are the same as S1605, S1610 and S1615, and redundant descriptions thereof are thus omitted. In addition, although not described in FIG. 17 to omit the redundant operations, S1650, S1655, S1660, S1665 and S1670 may be applied to the embodiment of FIG. 17.

The washing machine 100 may perform the specific washing course based on the first user input (S1720).

In addition, the washing machine 100 may transmit identification information on the washing machine 100, the washing course information, and the control option information to the server 300 (S1725). The washing course information may indicate the identification information corresponding to the washing course, the control command and the detailed option of the identified washing course. Here, the identification information corresponding to the washing course may indicate a unique number specifying the identified washing course among the plurality of washing courses. Here, the detailed option may indicate the detailed function of the identified washing course.

The server 300 may identify the drying course based on the washing course included in the washing course information received from the washing machine 100 and the control option selected by the user (S1730). If other washing course and control option are identified, an identified drying course may also be different. In addition, the server 300 may obtain the identification information on the dryer 200 corresponding to the identification information on the washing machine 100 based on the identification information on the washing machine 100 received from the washing machine 100 (S1735). In addition, the server 300 may generate the drying course information including the drying course identified in S1730 and the identification information on the dryer 200 obtained in S1735. In addition, the server 300 may transmit the generated drying course information to the dryer 200 (S1740).

In addition, the dryer 200 may reserve the drying course based on the drying course information received from the server 300 (S1745). In addition, after the washing course performed in the washing machine 100 is completed, the dryer 200 may perform the reserved drying course.

Figure 18:
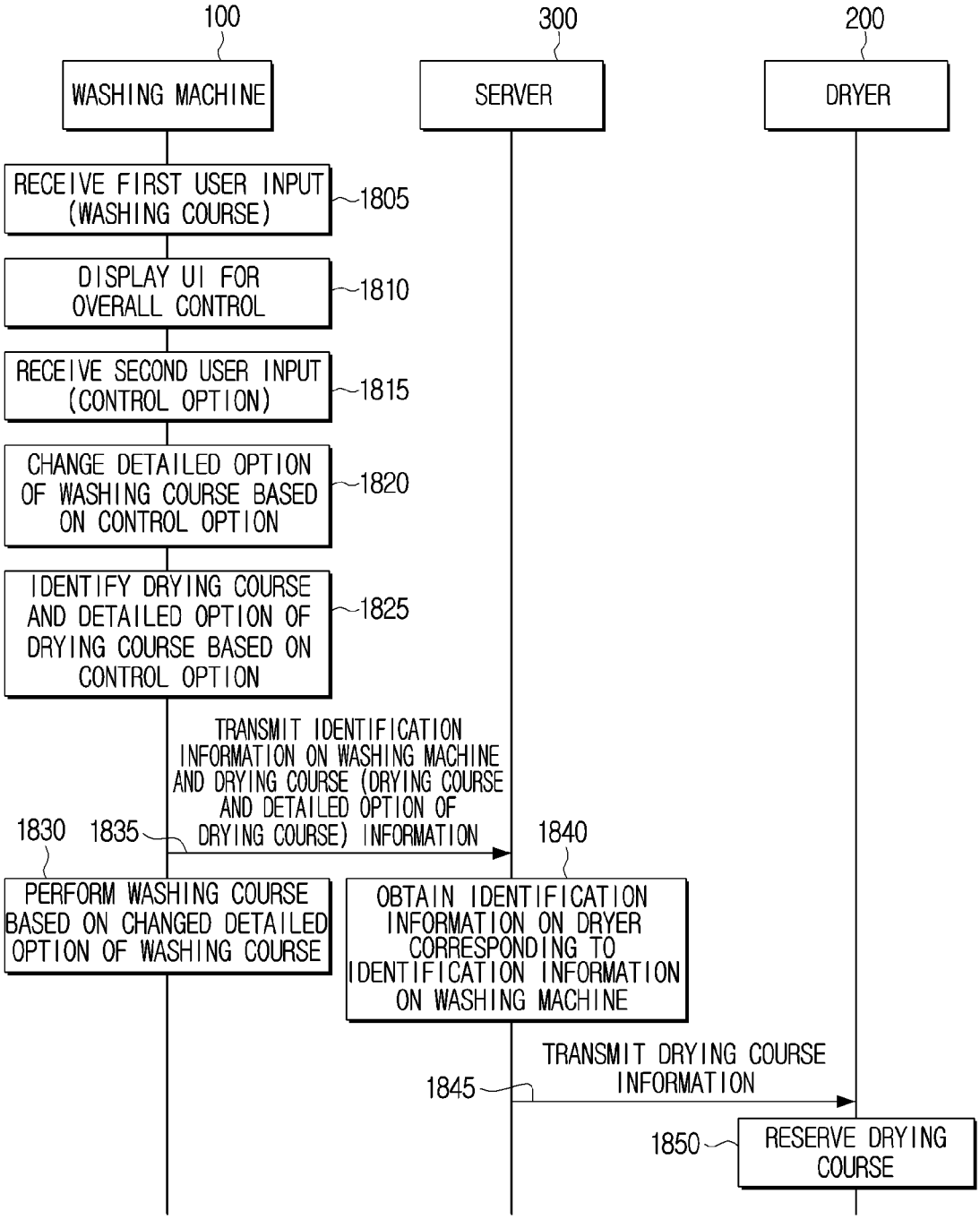
FIG. 18 is a flowchart showing that the overall control is performed using the washing machine, the dryer and the server according to another embodiment.

FIG. 18 is a flowchart showing that the overall control is performed using the washing machine, the dryer and the server according to another embodiment.

Referring to FIG. 18, the washing machine 100 may receive the first user input (washing course) (S1805), may display the UI for overall control (S1810), and may receive the second user input (control option) among the plurality of control options included in the UI for overall control (S1815). S1805, S1810 and S1815 are the same as S1605, S1610 and S1615, and redundant descriptions thereof are thus omitted. In addition, although not described in FIG. 18 to omit the redundant operations, S1650, S1655, S1660, S1665 and S1670 may be applied to the embodiment of FIG. 18.

If the user selects the washing course, the detailed option corresponding to the washing course may be predetermined. The washing machine 100 may change the detailed option of the washing course based on the control option selected by the user (S1820). For example, if the user selects the standard washing course, the detailed option of the standard washing course may be washing time of one hour, washing temperature of 40 degrees, two rinsing times, and medium dehydration intensity. Here, if the user selects the energy saving control option, the washing machine 100 may change the detailed option of the standard washing course to washing temperature of 30 degrees, two rinsing times and weak dehydration intensity.

In addition, the washing machine 100 may identify the drying course and the detailed option of the drying course based on the control option selected by the user (S1825). In detail, the washing machine 100 may determine an operation performed by the dryer 200 in order to obtain a result corresponding to the control option selected by the user. In addition, the washing machine 100 may generate the drying course information including the identification information corresponding to the identified drying course and the detailed option of the identified drying course. In addition, the washing machine 100 may perform the washing course based on the change detailed option of the washing course (S1830). In addition, the washing machine 100 may transmit the identification information on the washing machine and the drying course information to the server 300 (S1835).

The server 300 may obtain the identification information on the dryer 200 corresponding to the received identification information on the washing machine (S1840). In addition, the server 300 may transmit the drying course information to the dryer 200 based on the identified identification information on the dryer 200 (S1845).

In addition, the dryer 200 may reserve the drying course based on the drying course information received from the server 300 (S1850). In addition, after the washing course performed in the washing machine 100 is completed, the dryer 200 may perform the reserved drying course.

Figure 19:
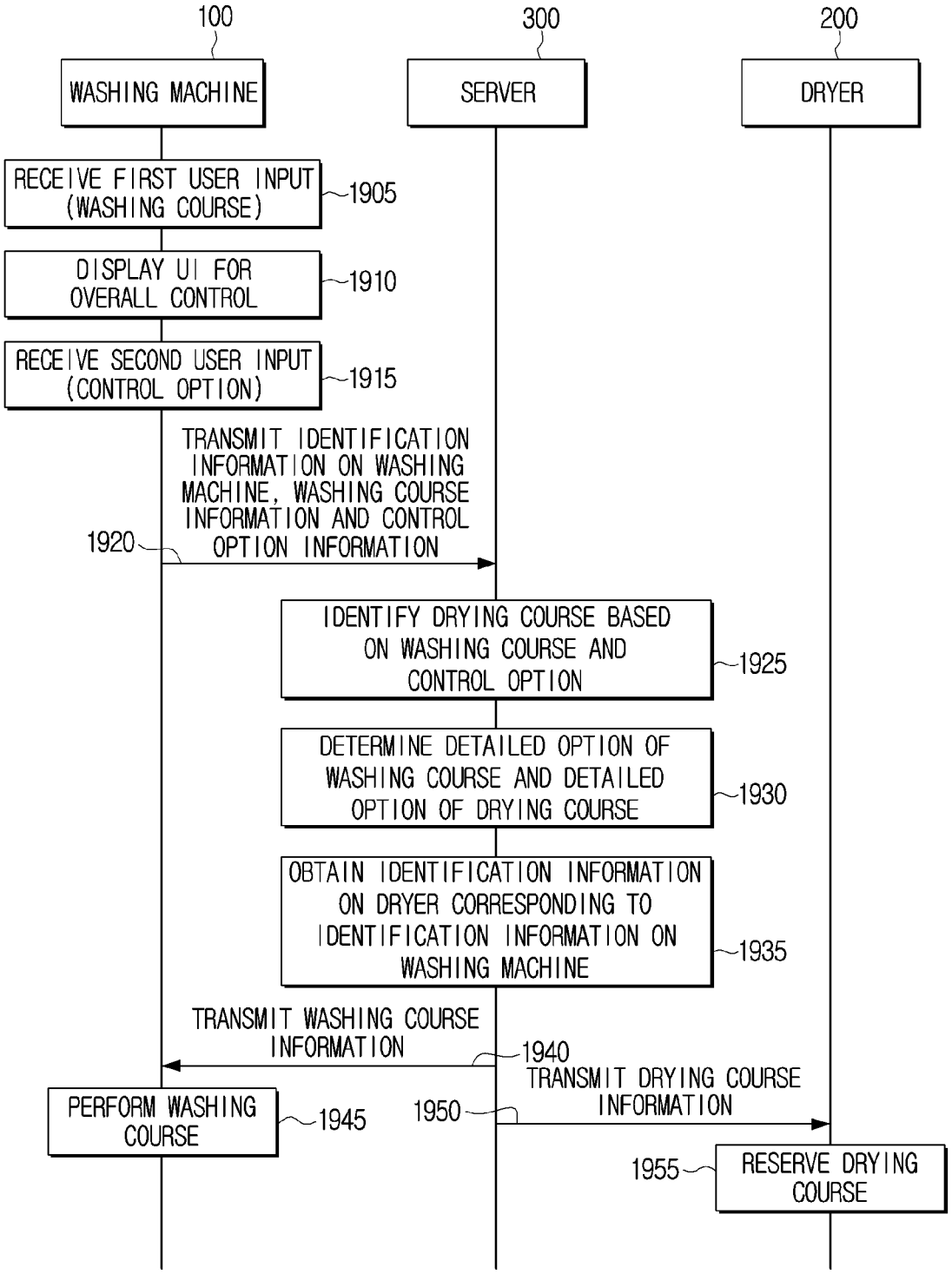
FIG. 19 is a flowchart showing that the overall control is performed using the washing machine, the dryer and the server according to another embodiment.

FIG. 19 is a flowchart showing that the overall control is performed using the washing machine, the dryer and the server according to another embodiment.

Referring to FIG. 19, the washing machine 100 may receive the first user input (washing course) (S1905), may display the UI for overall control (S1910), and may receive the second user input (control option) among the plurality of control options included in the UI for overall control (S1915). In addition, the washing machine 100 may transmit identification information on the washing machine 100, the washing course information, and the control option information to the server 300 (S1920). S1905, S1910, S1915 and S1920 are the same as S1705, S1710, S1715 and S1720, and redundant descriptions thereof are thus omitted In addition, although not described in FIG. 19 to omit the redundant operations, S1650, S1655, S1660, S1665 and S1670 may be applied to the embodiment of FIG. 19.

The server 300 may identify the drying course based on the washing course and the control option (S1925). In addition, the server 300 may determine the detailed option of the washing course and the detailed option of the drying course (S1930). In detail, the server 300 may change the detailed option of the washing course selected by the first user input for the result corresponding to the control option selected by the user, and determine the drying course and the detailed option of the drying course. In addition, the server 300 may obtain the identification information on the dryer 200 corresponding to the identification information on the washing machine 100 (S1935).

In addition, the server 300 may generate washing course information including the detailed option of the washing course and the control command. In addition, the server 300 may generate the drying course information including the detailed option of the drying course, the control command and the identification information corresponding to the drying course.

In addition, the server 300 may transmit the generated washing course information to the washing machine 100 (S1940). In addition, the washing machine 100 may perform the washing course based on the detailed option included in the received washing course information (S1945).

In addition, the server 300 may transmit the generated drying course information to the dryer 200 (S1950). In addition, the dryer 200 may reserve the drying course based on the drying course and the detailed option of the drying course, included in the received drying course information (S1955). In addition, after the washing course performed in the washing machine 100 is completed, the dryer 200 may perform the reserved drying course.

Figure 20:
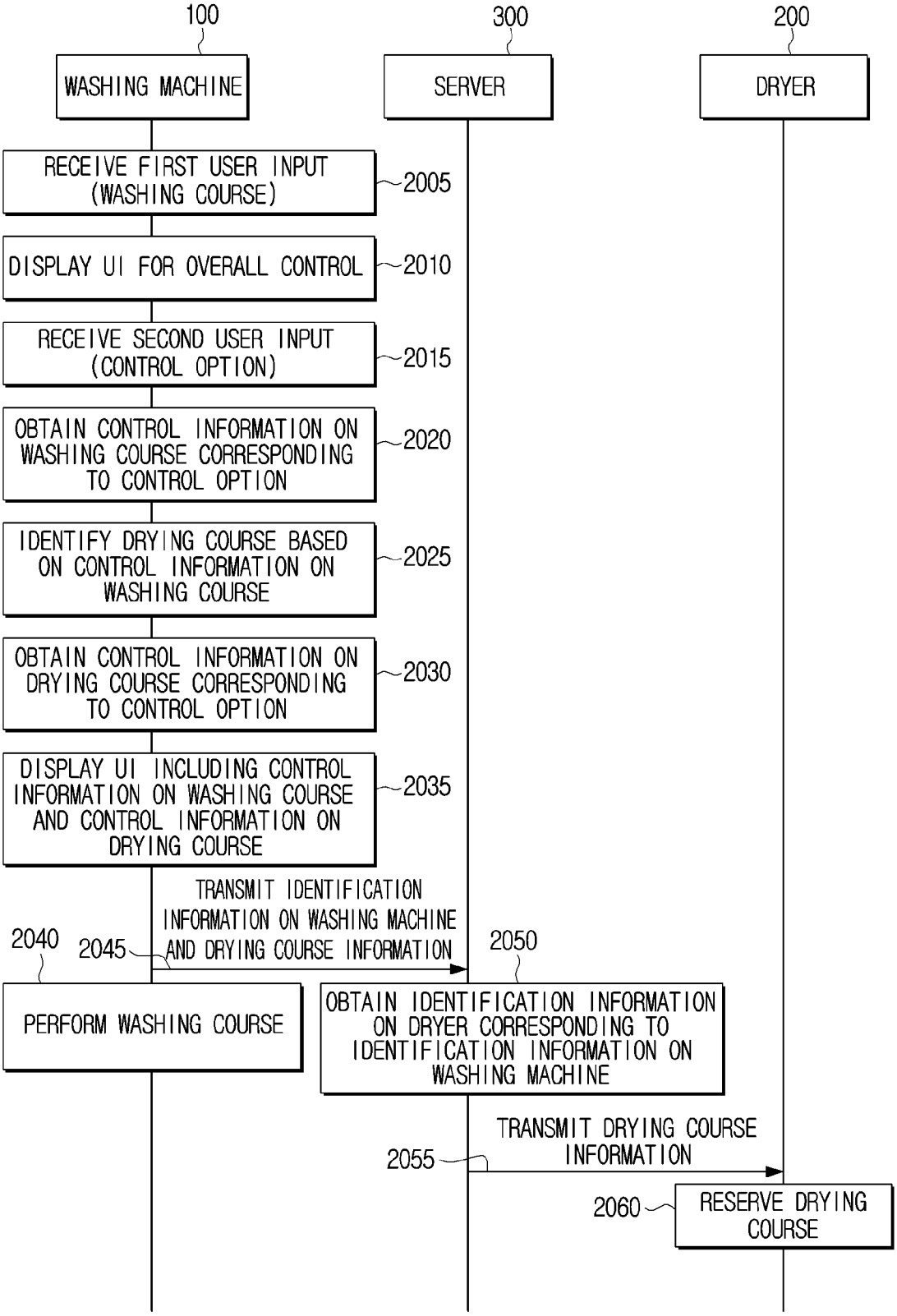
FIG. 20 is a flowchart showing that the overall control is performed using the washing machine, the dryer and the server according to another embodiment.

FIG. 20 is a flowchart showing that the overall control is performed using the washing machine, the dryer and the server according to another embodiment.

Referring to FIG. 20, the washing machine 100 may receive the first user input (washing course) (S2005), may display the UI for overall control (S2010), and may receive the second user input (control option) among the plurality of control options included in the UI for overall control (S2015). S2005, S2010 and S2015 are the same as S1605, S1610 and S1615, and redundant descriptions thereof are thus omitted. In addition, although not described in FIG. 20 to omit the redundant operations, S1650, S1655, S1660, S1665 and S1670 may be applied to the embodiment of FIG. 20.

The washing machine 100 may obtain the control information on the washing course corresponding to the control option selected by the user (S2020). Here, the control information may include at least one of the time information or the power consumption information on the washing course. For example, if the user selects the energy saving control, the washing machine 100 may obtain the time information (e.g., one hour) and the power consumption information (e.g., 2000 W) on the standard washing course received by the first user input.

In addition, the washing machine 100 may identify the drying course based on the control information on the obtained washing course (S2025). Here, the washing machine 100 may generate the drying course information including the identification information corresponding to the identified drying course, and the control command.

In addition, the washing machine 100 may obtain the control information on the drying course corresponding to the control option (S2030). For example, if the user selects the energy saving control, the washing machine 100 may identify the drying course corresponding to the standard washing course. In addition, the washing machine 100 may obtain the time information (e.g., three hours) and the power consumption information (e.g., 2500 W) on the drying course.

In addition, the washing machine 100 may generate the UI for overall control including the control information on the washing course obtained in S2020 and the control information on the drying course obtained in S2030, and display the generated UI for overall control (S2035). In addition, the washing machine 100 may perform the washing course (S2040).

In addition, the washing machine 100 may transmit the identification information on the washing machine 100 and the drying course information (S2045).

The server 300 may obtain the identification information on the dryer 200 corresponding to the identification information on the washing machine 100 received from the washing machine 100 (S2050). In addition, the server 300 may transmit the received drying course information to the dryer 200 based on the obtained identification information on the dryer 200 (S2055).

The dryer 200 may reserve the drying course based on the drying course information received from the server 300. In addition, after the washing course performed in the washing machine 100 is completed, the dryer 200 may perform the reserved drying course.

Meanwhile, according to an embodiment, the detailed option of the washing course may be changed based on the control option in S2020, and the washing machine 100 may obtain control information based on the changed detailed option.

FIG. 21 is a table showing the detailed option of the washing course performed by the washing machine.

Referring to FIG. 21, a table 2100 may include a plurality of washing courses which may be performed by the washing machine 100 and a detailed option thereof. The detailed option of the washing machine 100 may include at least one of time, power consumption, washing temperature, the number of rinsing, dehydration intensity or washing degree.

The power consumption may be higher if the washing temperature is higher, the number of rinsing is more and the dehydration intensity is higher. The more in addition, the operation time of a washing course may be longer as the number of rinsing is more. Meanwhile, the washing degree may be higher if the washing time is longer, the washing temperature is higher, the number of rinsing is more and the dehydration intensity is strong. Here, the washing degree may indicate washing satisfaction or washing quality. That is, if the washing degree is high, this degree may indicate that the laundry is washed cleanly.

For example, the course of the washing machine 100 corresponding to the general control in the table 601 of FIG. 6 may be a 1-3-th course of the table 2100. For example, the course of the washing machine 100 corresponding to the energy saving control in the table 602 of FIG. 6 may be a 1-2-th course of the table 2100.

FIG. 22 is a table showing a detailed option of a drying course performed by the dryer.

Referring to FIG. 22, a table 2200 may include the plurality of drying courses which may be performed by the dryer 200 and the detailed option thereof. The detailed option of the dryer 200 may include at least one of time, power consumption, drying temperature, rotational speed or drying degree.

The power consumption may be higher if the drying time is longer, the drying temperature is higher and the rotational speed is faster.

For example, the course of the dryer 200 corresponding to the general control in the table 601 of FIG. 6 may be a 2-3-th course of the table 2200. In addition, the course of the dryer 200 corresponding to the energy saving control in the table 602 of FIG. 6 may be a 3-1-th course of the table 2200.

FIG. 23 is a table showing a quality level of the washing course and the drying course based on a combination thereof.

Referring to FIG. 23, a table 2300 may include a total quality level based on the determination operation of the washing machine 100 and the dryer 200. For example, if a 1-1-th course is performed by the washing machine 100 and a 1-1-th course is performed by the dryer 200, the quality level may be 1.

Here, the quality level may indicate a combined satisfaction level of the washed degree and the dry degree of the laundry.

Figure 24:
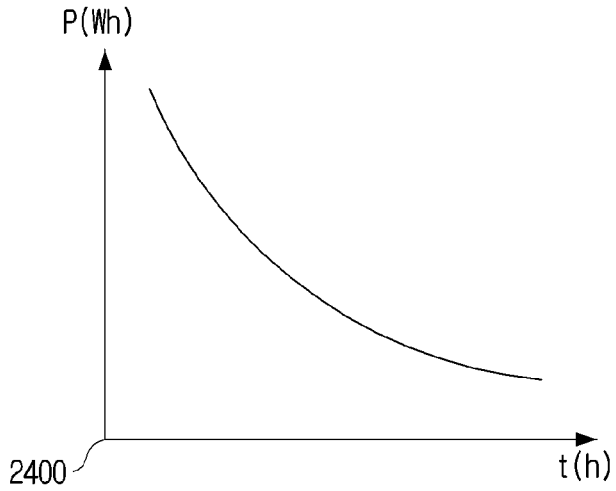
FIG. 24 is a graph showing a relationship between time and power amount at the same quality.

FIG. 24 is a graph showing a relationship between the time and power amount at the same quality.

Referring to FIG. 24, a graph 2400 may show a relationship between time and power consumption on a basis of various embodiments in which the washing machine 100 and the dryer 200 are controlled in various courses in order to obtain the laundry of the predetermined quality.

In order to complete the washing and the drying in short time, the washing machine 100 may have less number of rinsing and stronger dehydration. In addition, the dryer 200 may have its temperature increased to the maximum, and a higher rotational speed. The washing and the drying may be completed in the short time, but the power consumption may be high because the capabilities of the washing machine 100 and the dryer 200 are required to be used to the maximum.

On the contrary, the power consumption may be lowered if the washing machine has the weak dehydration while having more number of rinsing, and if the dryer has the slower rotational speed while having the lower temperature. However, the washing machine 100 and the dryer 200 may be operated for long time and it may thus take long time.

The controlling method of the washing machine 100 and the dryer 200 according to an embodiment of the disclosure may be determined based on this relationship between time and power consumption.

Figure 25:
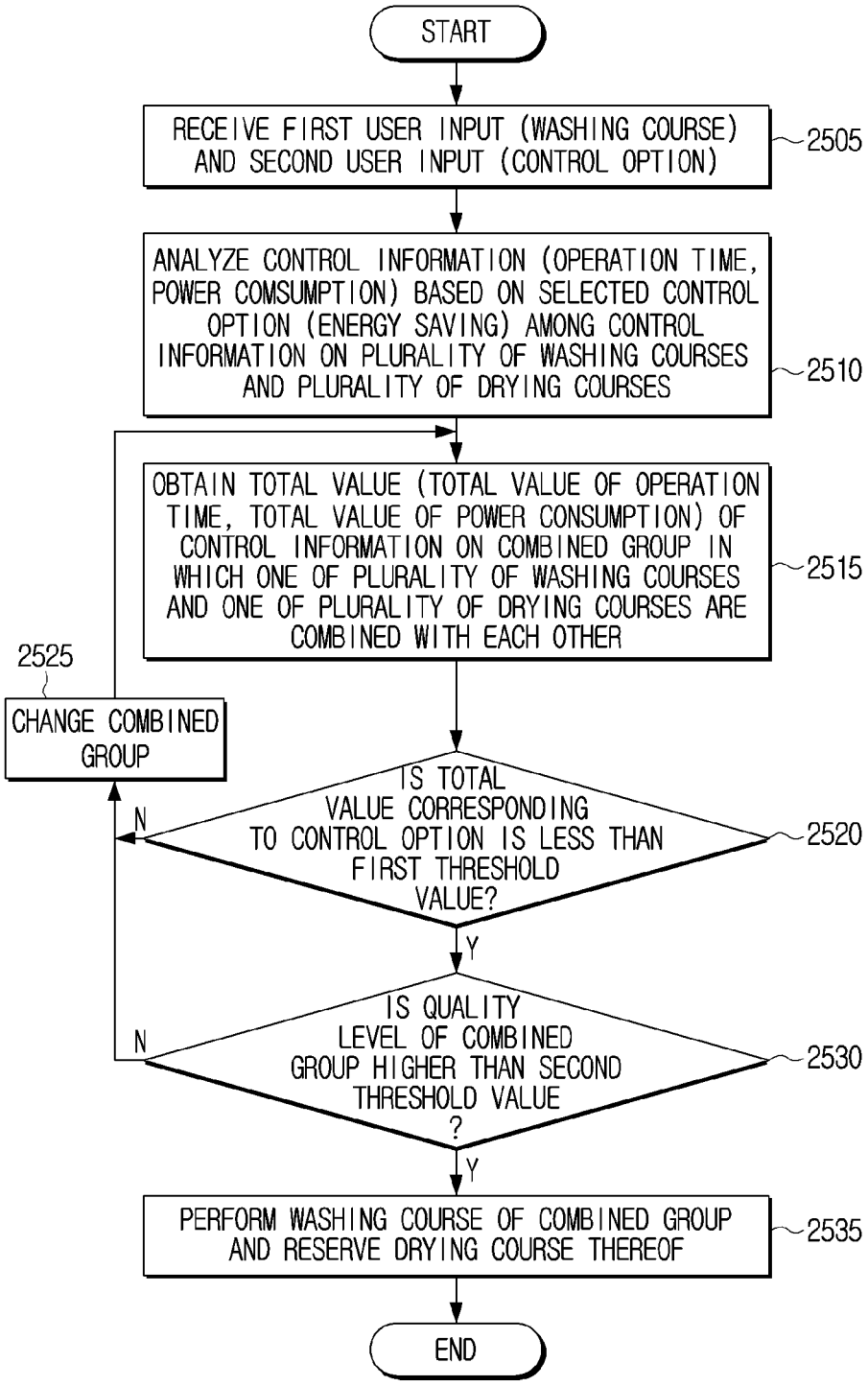
FIG. 25 is a flowchart showing an operation identifying the combination based on a control option among a plurality of courses included in the washing machine and the dryer.

FIG. 25 is a flowchart showing an operation identifying the combination based on the control option among a plurality of courses included in the washing machine and the dryer.

Referring to FIG. 25, the washing machine 100 may receive the washing course through the first user input and the control option through the second user input (S2505). In addition, the washing machine 100 may analyze the control information based on the selected control option among the control information on the plurality of washing courses and the plurality of drying courses (S2510). For example, it is assumed that the user selects the energy saving control. Here, the washing machine 100 may obtain the control information corresponding to each course by using the table 2100 and the table 2200. Here, the control information may indicate at least one of the time information or the power consumption information.

The washing machine 100 may obtain a total value of the control information on the combined group in which one of the plurality of washing courses and one of the plurality of drying courses are combined with each other (S2515). Here, the total value of the control information may include at least one of a total value of the time or a total value of the power consumption. For example, in the table 601 of FIG. 6, the total value of the time may be three hours and the total value of the power consumption may be 5000 Wh. In addition, in the table 602 of FIG. 6, the total value of the time may be four hours and the total value of the power consumption may be 4000 Wh. The embodiment of the table 601 may be an embodiment showing a group in which the 1-3-th course of the washing machine 100 and the 2-3-th course of the dryer 200 are combined with each other. The embodiment of the table 602 may be an embodiment showing a group in which the 1-2-th course of the washing machine 100 and the 3-1-th course of the dryer 200 are combined with each other.

In addition, the washing machine 100 may determine whether the total value (e.g., total value of the power consumption) corresponding to the control option (e.g., energy saving control) selected by the user among the total values of the combined group is less than a first threshold value (S2520). Here, the first threshold value may be a value pre-stored based on the control option. For example, if the energy saving control is the selected control option, the first threshold value may indicate maximum allowable power consumption to save the energy. The washing machine 100 may store the first threshold value as predetermined power consumption in order not to exceed the maximum power consumption. As another example, if the time saving control is the selected control option, the first threshold value may indicate maximum operation time required to save the time. The washing machine 100 may store the first threshold value as predetermined time in order not to exceed the maximum time.

Here, if the total value corresponding to the control option is the first threshold value or more, the washing machine 100 may change the combined group (S2525). In addition, S2515 may be performed based on the changed combined group.

Meanwhile, if the total value corresponding to the control option is a second threshold value or less, the washing machine 100 may determine whether quality level of the combined group is higher than the second threshold value (S2530). Here, the second threshold value may indicate the minimum quality level. Even in case of applying the energy saving control option or the time saving control option, there is a need to satisfy the minimum quality level of the washing and the drying. Therefore, among various combinations of the washing course and the drying course, a group that fails to satisfy the minimum quality level may be excluded from a final decision.

Here, if the total value corresponding to the control option is less than the second threshold value, the washing machine 100 may change the combined group (S2525). In addition, S2515 may be performed based on the changed combined group.

Meanwhile, if the total value corresponding to the control option is the second threshold value or more, the washing machine 100 may perform the washing course of the combined group and reserve the drying course of the combined group (S2535).

Figure 26:
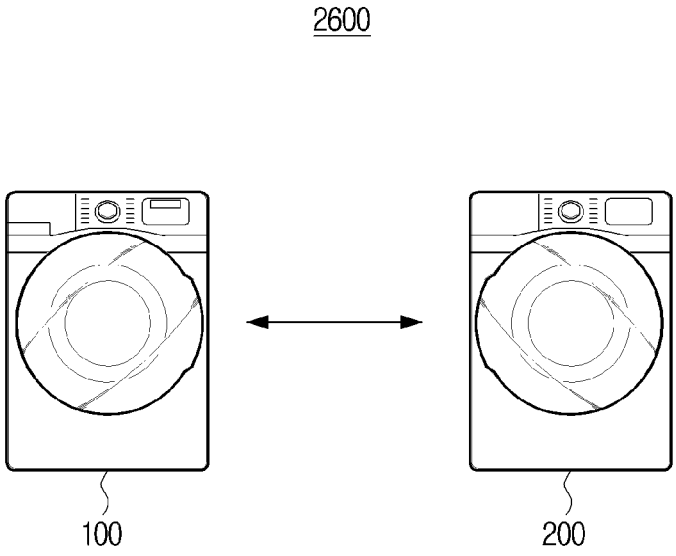
FIG. 26 is a diagram showing that the washing machine and the dryer directly communicate with each other according to an embodiment.

FIG. 26 is a diagram showing that the washing machine and the dryer directly communicate with each other according to an embodiment.

Referring to FIG. 26, in a system 2600 according to another embodiment, the washing machine 100 and the dryer 200 may directly communicate with one another.

For example, the washing machine 100 and the dryer 200 may be connected to each other through a wired cable, and information may be exchanged with each other through the wired cable connected thereto.

As another example, the washing machine 100 and the dryer 200 may be connected to each other through a wireless communication interface to directly exchange information with each other.

Figure 27:
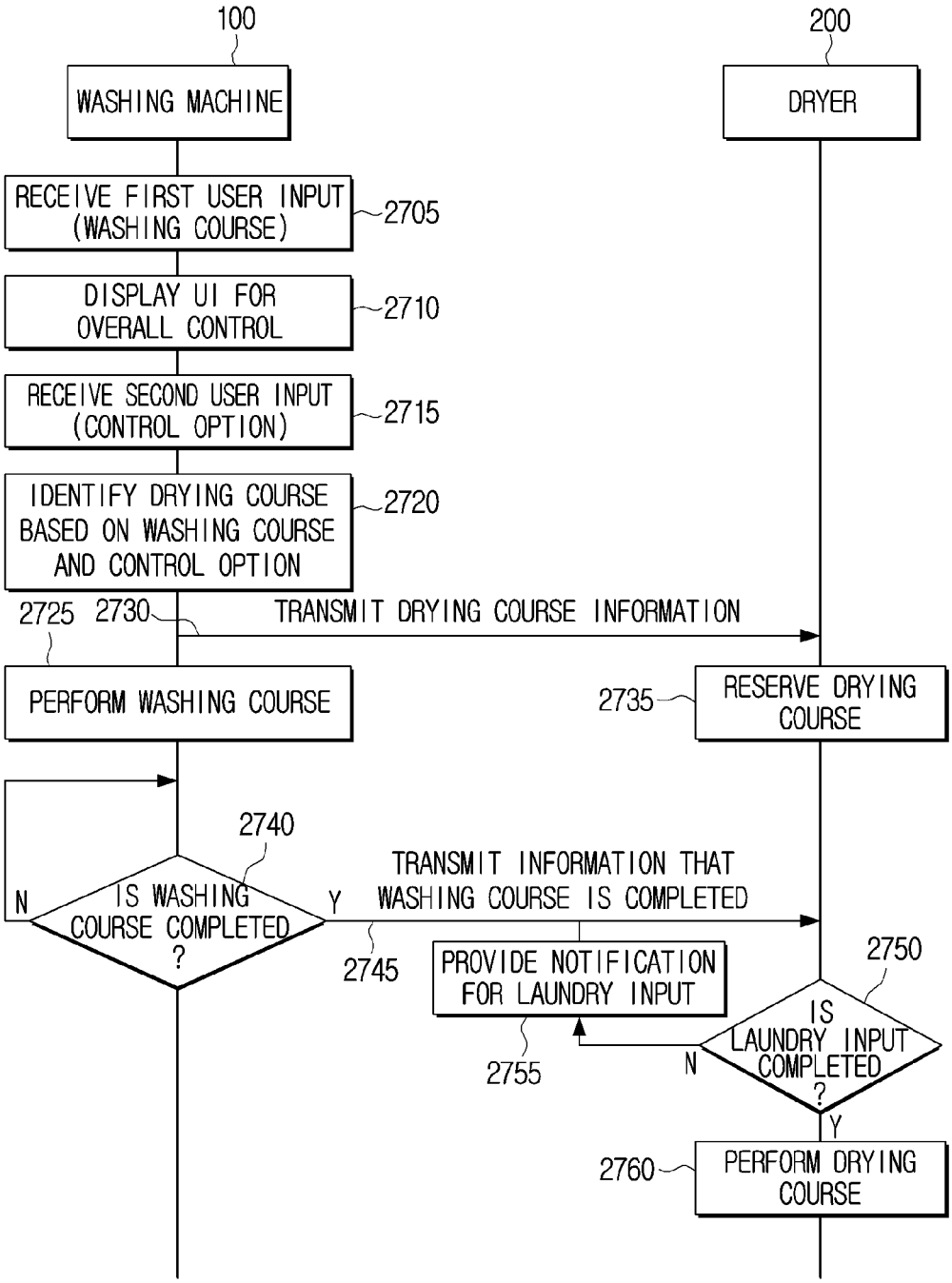
FIG. 27 is a flowchart showing that the overall control is performed using the washing machine and the dryer according to an embodiment.

FIG. 27 is a flowchart showing that the overall control is performed using the washing machine and the dryer according to an embodiment.

Referring to FIG. 27, S2705, S2710, S2715, S2720 and S2725 may correspond to S1605, S1610, S1615, S1620 and S1625 of FIG. 16, and redundant descriptions thereof are thus omitted.

The washing machine 100 may transmit the drying course information to the dryer 200 (S2730). In addition, the dryer 200 may reserve the drying course based on the drying course information received from the washing machine 100 (S2735). In addition, after the washing course performed in the washing machine 100 is completed, the dryer 200 may perform the reserved drying course. In detail, S2740, S2745, S2750, S2755 and S2760 may correspond to S1650, S1655, S1660, S1665 and S1670 of FIG. 16, and redundant descriptions thereof are thus omitted.

Figure 28:
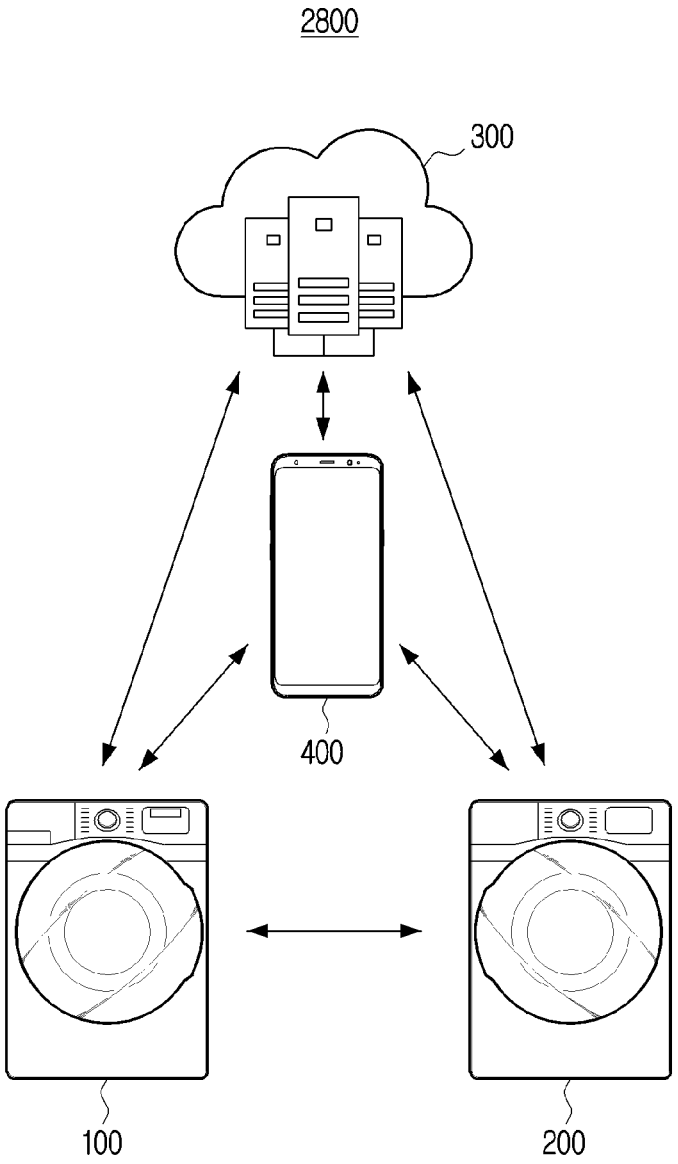
FIG. 28 is a diagram showing that the overall control is performed using the washing machine, the dryer, a terminal device and the server according to an embodiment.

FIG. 28 is a diagram showing that the overall control is performed using the washing machine, the dryer, the terminal device and the server according to an embodiment.

Referring to FIG. 28, in a system 2800 according to another embodiment, the washing machine 100, the dryer 200, the server 300 and the terminal device 400 may communicate with one another. Here, the terminal device 400 may indicate a portable device such as a smartphone or a tablet. The terminal device 400 may communicate with a plurality of pre-registered electronic devices. Here, it is assumed that the pre-registered devices are the washing machine 100 and the dryer 200. The terminal device 400 may receive information from or transmit information to the washing machine 100 and the dryer 200.

Meanwhile, the terminal device 400 may communicate with the server 300. The terminal device 400 may transmit information received from the washing machine 100 and the dryer 200 to the server 300. In addition, the terminal device 400 may transmit information received from the server 300 to the washing machine 100 and the dryer 200.

Meanwhile, according to the embodiment, the washing machine 100 and the dryer 200 may directly communicate with each other as shown in the embodiment of FIG. 26, and the washing machine 100 and the dryer 200 may communicate with each other through the server 300 as shown in the embodiment of FIG. 15. Here, the terminal device 400 may be used to perform a specific operation. For example, the terminal device 400 may display the UI or provide the notification.

It may be more convenient for the user to use the terminal device 400 than to select the UI displayed on the washing machine 100, which has a limitation on a size of the display.

Figure 29:
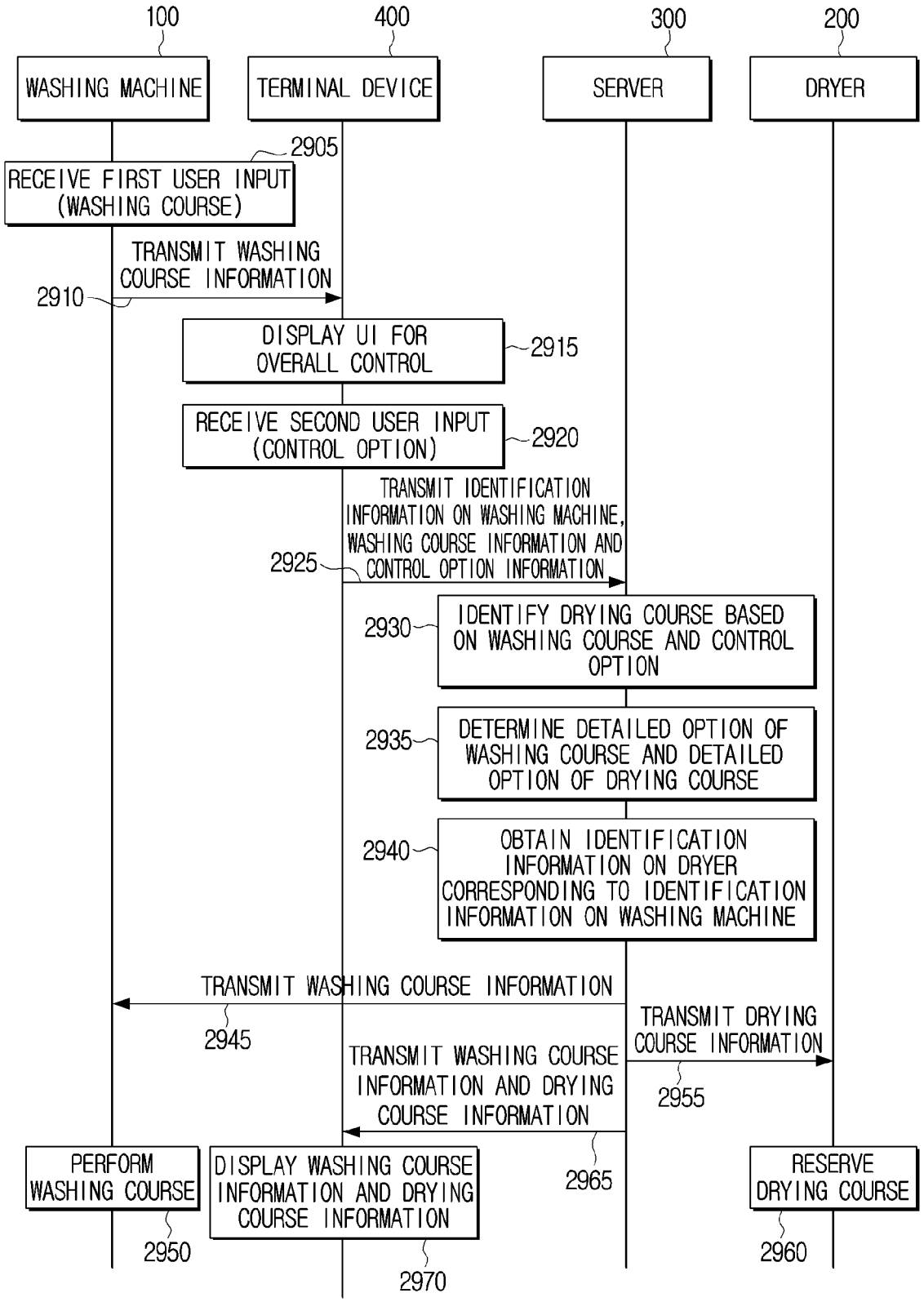
FIG. 29 is a flowchart showing that the overall control is performed using the washing machine, the dryer, the terminal device and the server according to an embodiment.

FIG. 29 is a flowchart showing that the overall control is performed using the washing machine, the dryer, the terminal device and the server according to an embodiment.

Referring to FIG. 29, the washing machine 100 may receive the washing course by the first user input (S2905). In addition, the washing machine 100 may transmit the washing course information received (input) by the first user input to the terminal device 400 (S2910).

In addition, the terminal device 400 may display the UI for overall control based on the received washing course information (S2915). In addition, the terminal device 400 may receive the control option by the second user input based on the displayed UI for overall control (S2920). In addition, the terminal device 400 may transmit identification information on the washing machine, the washing course information, and the control option information to the server 300 (S2925).

The server 300 may identify the drying course based on the received washing course information and the received control option (S2930). In addition, the server 300 may determine the detailed option of the washing course and the detailed option of the drying course (S2935). In addition, the server 300 may obtain the identification information on the dryer 200 corresponding to the received identification information on the washing machine 100 (S2940).

The server 300 may transmit the washing course information to the washing machine 100 (S2945). In addition, the washing machine 100 may perform the washing course based on the received washing course information (S2950).

In addition, the server 300 may transmit the drying course information to the dryer 200 (S2955). In addition, the dryer 200 may reserve the drying course (S2960). In addition, after the washing course performed in the washing machine 100 is completed, the dryer 200 may perform the reserved drying course. Here, although not described in FIG. 29 to omit the redundant operations, S1650, S1655, S1660, S1665 and S1670 may be applied to the embodiment of FIG. 29.

In addition, the server 300 may transmit the washing course information and the drying course information to the terminal device 400 (S2965). In addition, the terminal device 400 may display the received washing course information and the received drying course information on the display of the terminal device 400 (S2970).

Figure 30:
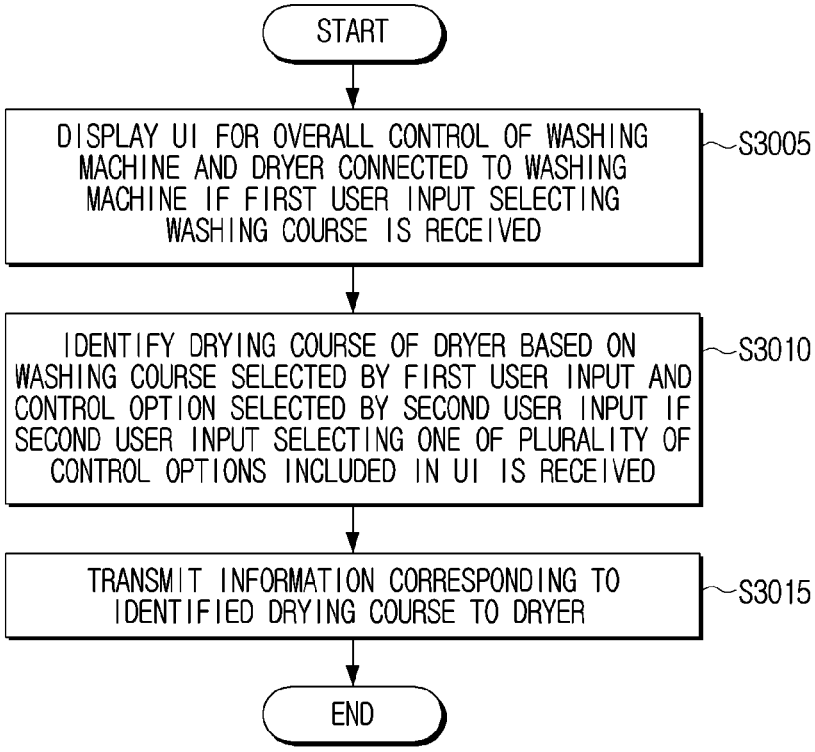
FIG. 30 is a flowchart showing a controlling method of a washing machine according to an embodiment of the disclosure.

FIG. 30 is a flowchart showing a controlling method of a washing machine according to an embodiment of the disclosure.

Referring to FIG. 30, a controlling method of a washing machine 100 according to an embodiment of the disclosure may include displaying a user interface (UI) for overall control of the washing machine 100 and a dryer 200 connected to the washing machine 100 in communication based on a first user input selecting a washing course being received (S3005).

In addition, the controlling method may include identifying a drying course of the dryer 200 based on the washing course selected by the first user input and a control option selected by a second user input based on the second user input selecting one of the plurality of control options included in the UI being received (S3010). In addition, the controlling method may include transmitting information corresponding to the identified drying course to the dryer 200 (S3015).

Here, the plurality of control options may be the control options applicable to both the washing course of the washing machine 100 and the drying course of the dryer 200.

Here, the control option may be an option for at least one of energy saving control, general control or time saving control.

Meanwhile, the controlling method may further include obtaining control information on the selected washing course based on the selected control option, and obtaining the drying course of the dryer 200 and control information on the drying course based on the control option, based on the obtained control information.

Here, in the displaying of the UI, a UI including the control information on the washing course and the control information on the drying course may be displayed.

Meanwhile, the controlling method may further include providing guide information recommending at least one control option among the plurality of control options included in the UI based on a user history related to at least one of the washing machine 100 or the dryer 200.

Meanwhile, the controlling method may further include determining an order in which the plurality of control options included in the UI are displayed based on the user history related to at least one of the washing machine 100 or the dryer 200.

Meanwhile, the control option may include the option for at least one of the energy saving control, the general control or the time saving control, control power corresponding to the energy saving control may be determined based on the user history related to at least one of the washing machine 100 or the dryer 200, and control time corresponding to the time saving control may be determined based on the user history related to at least one of the washing machine 100 or the dryer 200.

Meanwhile, if the drying course of the dryer 200 is identified, the controlling method may further include identifying the detailed option of the drying course based on the selected control option, and transmitting information including the detailed option of the identified specific drying course to the dryer 200.

Meanwhile, in the transmitting of the information (S3015), the information corresponding to the identified drying course may be transmitted to the dryer 200 through the external server 300.

Meanwhile, the controlling method of the washing machine 100 as shown in FIG. 30 may be performed by the washing machine 100 having the configuration of FIG. 1 or 2, and may also be performed by an electronic device having another configuration. For example, the controlling method as shown in FIG. 30 may be performed by the server 300 instead of the washing machine 100.

Meanwhile, the methods according to the various embodiments of the disclosure described above may be implemented in the form of an application which may be installed on an existing washing machine.

In addition, the methods according to the various embodiments of the disclosure described above may be implemented only by software upgrade or hardware upgrade for the existing electronic device (washing machine).

In addition, the various embodiments of the disclosure described above may be performed through an embedded server included in the electronic device or an external server of at least one of the electronic device or a display device.

Meanwhile, according to an embodiment of the disclosure, the various embodiments described above may be implemented by software including an instruction stored in a machine-readable storage medium (for example, a computer-readable storage medium). A machine may be a device that invokes the stored instruction from the storage medium and may be operated based on the invoked instruction, and may include the electronic device according to the disclosed embodiments. In case that a command is executed by a processor, the processor may directly perform a function corresponding to the command or may use other components to perform the function corresponding to the command under a control of the processor. The command may include codes generated or executed by a compiler or an interpreter. The machine-readable storage medium may be provided in the form of a non-transitory storage medium. Here, the term 'non-transitory' indicates that the storage medium is tangible without including a signal, and does not distinguish whether data are semi-permanently or temporarily stored in the storage medium.

In addition, according to an embodiment of the disclosure, the method according to the various embodiments described above may be provided by being included in a computer program product. The computer program product may be traded as a product between a seller and a purchaser. The computer program product may be distributed in the form of a storage medium (for example, a compact disc read only memory (CD-ROM)) that may be read by the machine or online through an application store (for example, PlayStore™). In case of the online distribution, at least a portion of the computer program product may be at least temporarily stored in a storage medium such as a memory of a server of a manufacturer, a server of an application store, or a relay server, or be temporarily generated.

In addition, each component (for example, module or program) according to the various embodiments described above may include a single entity or a plurality of entities, and some of the corresponding sub-components described above may be omitted or other sub-components may be further included in the various embodiments. Alternatively or additionally, some of the components (for example, modules or programs) may be integrated into one entity, and may perform functions performed by the respective corresponding components before being integrated in the same or similar manner. Operations performed by the modules, the programs, or other components according to the various embodiments may be executed in a sequential manner, a parallel manner, an iterative manner, or a heuristic manner, at least some of the operations may be performed in a different order or be omitted, or other operations may be added.

Although the embodiments of the disclosure are illustrated and described hereinabove, the disclosure is not limited to the above-mentioned specific embodiments, but may be variously modified by those skilled in the art to which the disclosure pertains without departing from the scope and spirit of the disclosure as disclosed in the accompanying claims. These modifications also need to be understood to fall within the scope of the disclosure.

The invention claimed is:

1. A washing machine comprising:

a display;

a communication interface; and a processor, wherein the processor is configured to:

control the display to display a first user interface (UI) for overall control of the washing machine and a dryer communicatively coupled to the washing machine based on a first user input selecting a washing course, determine, for display by the first UI, based on the selected washing course, a plurality of dual control options applicable to both a washing course of the washing machine and a drying course of the dryer, including at least an energy saving control, a general control, and a time saving control, receive a second user input selecting a dual control option from among the plurality of dual control options determined for display by the first UI, based on the second user input being received, identify the drying course of the dryer according to the washing course selected by the first user input and the dual control option selected by the second user input, and control the communication interface to transmit information corresponding to the identified drying course to the dryer.

2. The washing machine as claimed in claim 1, wherein the processor is configured to:

obtain first control information on the selected washing course based on the selected dual control option, and obtain the drying course of the dryer and second control information on the drying course based on the selected dual control option, based on the obtained first control information.

3. The washing machine as claimed in claim 2, wherein the processor is configured to control the display to display a second UI including the first control information on the washing course and the second control information on the drying course.

4. The washing machine as claimed in claim 1, wherein the processor is configured to control guide information recommending at least one control option among the plurality of dual control options included in the first UI to be provided based on a user history related to at least one of the washing machine or the dryer.

5. The washing machine as claimed in claim 1, wherein the processor is configured to determine an order in which the plurality of dual control options included in the first UI are displayed based on a user history related to at least one of the washing machine or the dryer.

6. The washing machine as claimed in claim 1, wherein a control power corresponding to the energy saving control is determined based on a user history related to at least one of the washing machine or the dryer, and wherein a control time corresponding to the time saving control is determined based on a user history related to at least one of the washing machine or the dryer.

7. The washing machine as claimed in claim 1, wherein if the drying course of the dryer is identified, the processor is configured to:

identify a detailed option of the drying course based on the selected dual control option, and control the information including the detailed option of the identified drying course to be transmitted to the dryer.

8. The washing machine as claimed in claim 1, wherein the processor is configured to control the information corresponding to the identified drying course to be transmitted to the dryer through an external server.

9. The washing machine as claimed in claim 1, wherein the processor is configured to transmit the UI for display on an external device.

10. The washing machine as claimed in claim 9, wherein the processor is configured to receive, from the external device, control information comprising one or more of the first user input or the second user input.

11. The washing machine as claimed in claim 1, wherein the processor is configured to:

identify applicable control option corresponding to the washing course selected by the first user input and inapplicable control option corresponding to the washing course selected by the first user input among the plurality of dual control options, and control the display to display an object for guiding the inapplicable control option is inapplicable in the first UI.

12. A controlling method of a washing machine, the controlling method comprising:

displaying a user interface (UI) for overall control of the washing machine and a dryer connected to the washing machine in communication based on a first user input selecting a washing course being received;

determining, for display by the UI, a plurality of dual control options applicable to both a washing course of the washing machine and a drying course of the dryer, including at least an energy saving control, a general control, and a time saving control;

receiving a second user input selecting a dual control option from among the plurality of dual control options determined for display by the UI, based on the second user input being received, identifying the drying course of the dryer according to the washing course selected by the first user input and the dual control option selected by the second user input; and transmitting information corresponding to the identified drying course to the dryer.

13. The controlling method as claimed in claim 12, further comprising:

obtaining control information on the selected washing course based on the selected dual control option; and obtaining the drying course of the dryer and control information on the drying course based on the selected dual control option, based on the obtained control information.

14. The controlling method as claimed in claim 13, wherein displaying of the UI further comprises displaying a second UI including the control information on the washing course and the control information on the drying course is displayed.

15. The controlling method as claimed in claim 12, further comprising transmitting the UI for display on an external device.

16. The controlling method as claimed in claim 15, further comprising receiving, from the external device, control information comprising one or more of the first user input or the second user input.

17. The controlling method as claimed in claim 15, further comprising:

identifying applicable control option corresponding to the washing course selected by the first user input and inapplicable control option corresponding to the washing course selected by the first user input among the plurality of dual control options, and displaying an object for guiding the inapplicable control option is inapplicable in the UI.

* * * * *